US006476561B2

(12) United States Patent
Okada

(10) Patent No.: US 6,476,561 B2
(45) Date of Patent: Nov. 5, 2002

(54) GAS DISCHARGE DISPLAY DEVICE WITH SUPERIOR PICTURE QUALITY

(75) Inventor: Taku Okada, Kadoma (JP)

(73) Assignee: Matsushita Electric Industrial Co., Ltd., Osaka-Fu (JP)

( * ) Notice: Subject to any disclaimer, the term of this patent is extended or adjusted under 35 U.S.C. 154(b) by 0 days.

(21) Appl. No.: 09/921,236

(22) Filed: Aug. 2, 2001

(65) Prior Publication Data

US 2002/0033677 A1 Mar. 21, 2002

(30) Foreign Application Priority Data

Aug. 3, 2000 (JP) ..... 2000-236231

(51) Int. Cl.[7] ..... G09G 3/10

(52) U.S. Cl. ..... 315/169.1; 315/169.4; 345/68

(58) Field of Search ..... 315/169.1, 169.3, 315/169.4; 345/60, 76, 68

(56) References Cited

U.S. PATENT DOCUMENTS 6,066,923 A * 5/2000 Noborio et al. ..... 313/582

FOREIGN PATENT DOCUMENTS

JP 5-79959 4/1993

* cited by examiner

*Primary Examiner*—David Vu
(74) *Attorney, Agent, or Firm*—Price and Gess

(57) ABSTRACT

To provide a gas discharge display device that can perform stable write operations for a gas discharge panel and thereby display images with superior quality. A base pulse is applied throughout a write period. The base pulse gradually varies with an approximately constant slope (an average slope of 10V/μsec or less), during an introduction part $I_a$ (i.e. from when the leading edge of the base pulse starts until immediately before the base pulse reaches a constant base voltage $V_b$) of the write period. A scan pulse $P_{sco}$ is not applied in the introduction part $I_a$, but is applied after the base pulse reaches the base voltage $V_b$.

17 Claims, 17 Drawing Sheets

GAS DISCHARGE DISPLAY DEVICE WITH SUPERIOR PICTURE QUALITY

This application is based on application No. H12-236231 filed in Japan, the content of which is hereby incorporated by reference.

BACKGROUND OF THE INVENTION

1. Field of the Invention

The present invention relates to a gas discharge display device used for image display for computers, televisions, and the like, and in particular to a surface discharge AC plasma display panel.

2. Related Art

In recent years, there have been high expectations for large-screen televisions with superior picture quality such as high-definition televisions. In the field of display devices, plasma display panels (hereafter referred to as PDPs) have become the focus of attention for their ability to produce large-screen slimline televisions, with sixty-inch models already having been developed.

PDPs can be roughly divided into direct current (DC) types and alternating current (AC) types. At present, AC types, which are suitable for large-screen use, are prevalent.

A typical surface discharge AC PDP is described hereafter. A front panel and a back panel are arranged in parallel to each other with barrier ribs interposed therebetween. Discharge gas is enclosed in a discharge space which is partitioned by the barrier ribs. Scan electrodes and sustain electrodes are aligned in parallel on the front panel, and a dielectric layer is formed on the front panel so as to cover the scan and sustain electrodes. Also, address electrodes and the barrier ribs are arranged on the back panel, and red phosphor layers, green phosphor layers, and blue phosphor layers are formed between the barrier ribs.

FIG. 13 shows an electrode matrix of this PDP. In the drawing, for example, the number n of scan lines L is 4, and the number m of address lines is 6.

Pairs of scan electrodes $SC_1$–$SC_4$ and sustain electrodes $SU_1$–$SU_4$ are arranged in parallel at a predetermined pitch, and address electrodes $A_1$–$A_6$ are aligned perpendicular to the scan and sustain electrodes. Discharge cells are formed at the points where the pairs of scan and sustain electrodes cross over the address electrodes. Adjacent discharge cells are separated by barrier ribs RIB1–RIB7.

To drive the PDP, drive circuits are used to apply pulses to the electrodes, which causes discharge and emission of ultraviolet light from the discharge gas. This ultraviolet light is absorbed by the particles of red, green, and blue phosphors in the phosphor layers, causing excited emission of light.

Discharge cells in an AC PDP are fundamentally only capable of two display states, ON and OFF. Accordingly, a field timesharing gradation display method is adopted whereby one field is divided into multiple sub-fields having predetermined weights and a gray scale is expressed by the combination of the sub-fields.

FIG. 14 shows a method of dividing one field when 256 gray levels are expressed. In the drawing, the horizontal direction represents time, and the areas filled in with black represent discharge sustain periods.

FIG. 15 shows an example of drive voltage waveforms which are applied to the electrodes in one sub-field, when driving the PDP according to the above method. As illustrated, one sub-field is made up of a write period, a sustain period, and an erase period.

In the write period, the sustain electrodes $SU_1$–$SU_n$ are held at a fixed potential (0V in this example). A write pulse $P_a$ is selectively applied to the address electrodes $A_1$–$A_m$ according to image data to be displayed, while a scan pulse $P_{scn}$ whose polarity is opposite to the write pulse $P_a$ is applied to the scan electrodes $SC_1$–$SC_n$.

As a result, the potential difference between the scan and address electrodes causes first write discharge, which in turn causes second write discharge between the scan and sustain electrodes (hereafter the first write discharge and the second write discharge are collectively called "write discharge"). Hence a wall charge necessary for sustain discharge to occur is accumulated.

By performing such write discharge sequentially for the scan electrodes $SC_1$–$SC_n$, image data to be displayed is written.

In the sustain period, AC sustain pulses $P_{sy}$ and PSX are applied in bulk to the scan electrodes $SC_1$–$SC_n$ and the sustain electrodes $SU_1$–$SU_n$. This causes sustain discharge to continuously occur in the discharge cells where the wall charge has been accumulated in the write period, as a result of which an image is displayed.

In the erase period, an erase pulse $P_e$ is applied to all sustain electrodes $SU_1$–$SU_n$, to cause erase discharge. As a result, the wall charge which remains after the sustain discharge is mostly neutralized.

According to this drive method, since a great number of scan lines need to be scanned within the write period, the write discharge tends to become unstable. When the write discharge is unstable, the light emission caused by the subsequent sustain discharge becomes unstable, too.

This problem appears to be solved by setting the voltage of the write pulse at a high level. However, limitations in the performance of the data driver make it impossible to increase the voltage of the write pulse.

Accordingly, to produce an excellent image display, it is of particular importance to perform write discharge reliably within a write period.

Recently, various PDPs have been developed to improve panel brightness. Examples are a PDP whose filling pressure of discharge gas is set equal to or greater than an atmospheric pressure, and a PDP whose discharge gas contains Xe at a partial pressure of 10% or more. Such PDPs have particularly high write discharge firing voltages and so the problem of unstable write discharge is more serious. For this reason, it is difficult to drive these PDPs by the drive method shown in FIG. 15.

To overcome this problem, a drive method that introduces a set-up period before the write period is disclosed by Japanese Laid-Open Patent Application No. H08-212930.

FIG. 17 shows an example of drive voltage waveforms according to this method. As shown in the drawing, a set-up pulse $P_{rn}$ of positive polarity is applied to the scan electrodes $SC_1$–$SC_n$ in the set-up period.

By such applying the set-up pulse of the rectangular wave, set-up discharge takes place and as a result the wall charge remaining in the discharge cells after the erase discharge is completely neutralized. Also, priming effects that assist the subsequent write discharge to occur easily and reliably are obtained. Thus, this method is effective to stabilize the write discharge, but the level of stabilization achieved solely by this method is still insufficient, and other solutions are desired too.

To stabilize the write discharge, Japanese Laid-Open Paten Application No. H06-289811 discloses a drive method that applies a base pulse whose polarity is opposite to a write pulse, to scan electrodes in a write period.

FIG. 16 shows an example of drive voltage waveforms according to this method. In the drawing, the positive write pulse $P_a$ is applied to the address electrodes $A_1$–$A_m$. Also, a base pulse having a base voltage $V_b$ of negative polarity and constant wave height is applied to the scan electrodes $SC_1$–$SC_n$, throughout the write period, and a negative scan pulse $P_{sco}$ is superimposed on the base pulse.

When the base pulse is applied to the scan electrodes in this way, the potential difference between the address and scan electrodes and the potential difference between the scan and sustain electrodes increase by the degree of the base pulse applied. This encourages the first write discharge and the second write discharge to occur more reliably. As a result, the write discharge takes place unfailingly with no need to increase the voltage of the write pulse, with it being possible to improve the picture quality.

This base pulse applying method can drive, with a certain measure of success, a PDP whose discharge gas filling pressure is equal to or greater than an atmospheric pressure and a PDP whose discharge gas contains Xe at a partial pressure of 10% or more.

Even in this method, however, if the absolute value of the base voltage $V_b$ is set high, discharge errors are likely to occur at the beginning of the write period, which results in a drop in picture quality.

For example, in the case where the base pulse applying method is adopted to a PDP which is less prone to write discharge due to variations in manufacturing or the like (hereinafter such a PDP is referred to as having low dischargeability), the absolute value of the base voltage $V_b$ need be set higher in order to increase the write voltage. This tends to cause discharge errors at the beginning of the write period, thereby deteriorating the picture quality.

It is thus desired to perform data writing reliably even for a PDP that requires a high write voltage.

SUMMARY OF THE INVENTION

The present invention aims to provide a gas discharge display device that can perform stable write operations on a gas discharge panel and thereby produce an image display of superior quality.

The stated object can be achieved by a gas discharge display device including: a gas discharge panel having a first substrate and a second substrate that are opposed to each other, a group of first electrodes and a group of second electrodes being arranged on a main surface of the first substrate which faces the second substrate, a group of third electrodes being arranged on a main surface of the second substrate which faces the first substrate so as to cross over the group of first electrodes and the group of second electrodes, and a discharge gas being enclosed in a gap between the first and second substrates; and a drive circuit which writes data in a write period, and sustains a discharge in a sustain period, wherein the drive circuit applies a scan pulse and a base pulse which is superimposed on the scan pulse, to the group of first electrodes in the write period, and a voltage of the base pulse varies at an average rate of no greater than 10V/μsec, during a first period from when the application of the base pulse starts until immediately before the application of the scan pulse starts.

With this construction, image data is written by applying the scan pulse to the first electrodes (scan electrodes) in sequence and at the same time applying the write pulse of the opposite polarity selectively to the third electrodes (address electrodes), in the write period. Following this, a voltage is applied between the first electrodes (scan electrodes) and the second electrodes (sustain electrodes) to sustain a discharge in the sustain period. As a result, an image is displayed.

Here, the base pulse which is applied to the scan electrodes is in principle of the same polarity as the scan pulse. Accordingly, even when the potential difference between the scan and write pulses is smaller than a write discharge firing voltage, if the sum of the potential difference and the base voltage exceeds the write discharge firing voltage, the voltage between the scan and address electrodes exceeds the write discharge firing voltage when the scan and write pulses are applied. Hence the write discharge takes place reliably.

The write discharge firing voltage referred to here is a voltage at which the write discharge starts in the write period.

In general, the wave height of the base pulse is substantially constant throughout the write period, but the wave height may vary within an extent that ensures the reliable write discharge, after the write discharge firing voltage is exceeded.

An explanation is given below, with regard to the average rate of change of voltage in the period from when the application of the base pulse starts until immediately before the application of the scan pulse starts.

The application of the base pulse starts at a point where the leading edge of the base pulse begins (in this specification, "leading edge" means a pulse portion that first increases in voltage in the case where the pulse is of positive polarity, and a pulse portion that first decreases in voltage in the case where the pulse is of negative polarity).

If the potential difference between the scan and write pulses is below the write discharge firing voltage, the sum of the potential difference and the voltage between the scan and address electrodes is smaller than the write discharge firing voltage when the application of the base pulse starts. The sum, however, increases with time, and eventually reaches the write discharge firing voltage at some point. Therefore, a voltage, which is sufficient for the above sum to exceed the write discharge firing voltage, needs to be applied between the scan and address electrodes before the application of the scan pulse begins.

Here, the average rate of change of voltage is set at 10V/μsec or below so that the voltage varies gradually, in the period from when the application of the base pulse begins (base pulse start point) until immediately before the application of the scan pulse begins. This delivers the following effects.

The inventors of the present invention examined the cause of discharge errors which occur at the beginning of the write period when the absolute value of the base voltage is set high, and reached the following conclusion. At the base pulse start point, the voltage between the scan and sustain electrodes exceeds the firing voltage while there is no discharge occurring between the address and scan electrodes. This causes a large discharge.

The inventors also found that even when the absolute value of the base voltage is high, if the voltage change after the base pulse start point is gradual, only a small discharge takes place after the voltage in a discharge cell exceeds the firing voltage, and there is no occurrence of a large discharge.

Thus, according to the invention, even when the absolute value of the base voltage is high, no discharge errors occur at the base pulse start point, which benefits reliable writing of data.

If a large discharge occurs at the base pulse start point, the contrast drops due to light emission associated with the discharge. According to the invention, however, such light emission is suppressed, so that the contrast is kept from dropping.

The effects of the invention can be enhanced when combined with the set-up pulse applying technique.

Which is to say, when the base pulse of the opposite polarity is applied in the write period after the set-up pulse is applied in the set-up period, discharge errors are more likely to occur in the base pulse start point. However, by making the voltage change in the base pulse start point gradual, such discharge errors are prevented, with it being possible to achieve greater effects.

In this case, it is preferable that the average voltage change rate of the leading and trailing edges of the set-up pulse is 10V/$\mu$sec or below. Also, it is preferable that the voltage continuously changes from the trailing edge of the set-up pulse through to the base pulse start point.

With the present invention, gas discharge panels which are conventionally difficult to drive, such as a gas discharge panel whose discharge gas filling pressure is no smaller than an atmospheric pressure and a gas discharge panel whose partial pressure of Xe in the discharge gas is no smaller than 10%, can be driven unfailingly.

BRIEF DESCRIPTION OF THE DRAWINGS

These and other objects, advantages and features of the invention will become apparent from the following description thereof taken in conjunction with the accompanying drawings which illustrate specific embodiments of the invention.

In the drawings.

DESCRIPTION OF THE PREFERRED EMBODIMENTS

Figure 1:
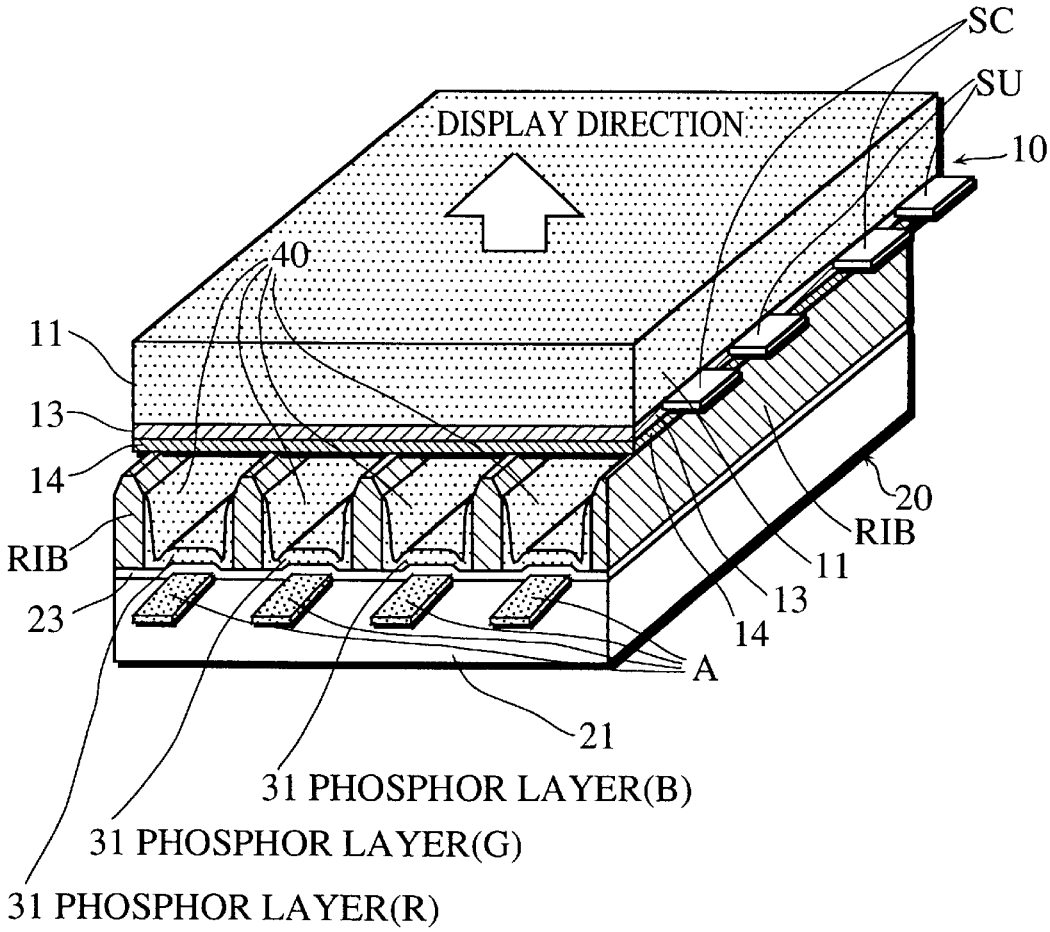
FIG. 1 is a perspective view showing a rough construction of a surface discharge AC PDP to which the embodiments of the invention relate.

The following describes embodiments of a gas discharge display device of the present invention, by referring to the drawings. The gas discharge display device of the invention is equipped with a gas discharge PDP and a drive device for driving the PDP.

Construction of the PDP

FIG. 1 is a perspective view showing a rough construction of a surface discharge AC PDP to which the embodiments of the invention relate.

Scan electrodes $SC_1$–$SC_n$ and sustain electrodes $SU_1$–$SU_n$, a dielectric layer 13, and a protective layer 14 are formed on a front glass substrate 11, thereby forming a front panel 10. Also, address electrodes $A_1$–$A_m$ and a dielectric layer 23 are formed on a back glass substrate 21, thereby forming a back panel 20. The front panel 10 and the back panel 20 are arranged in parallel to each other with a gap in between, so that the scan and sustain electrodes face the address electrodes. The gap between the front panel 10 and the back panel 20 is partitioned by barrier ribs RIB in the form of stripes, to form discharge spaces 40. Discharge gas is enclosed in these discharge spaces 40.

In the discharge spaces 40, phosphor layers 31 (red phosphors, green phosphors, and blue phosphors) are arranged in turn on the back panel 20.

Figure 13:
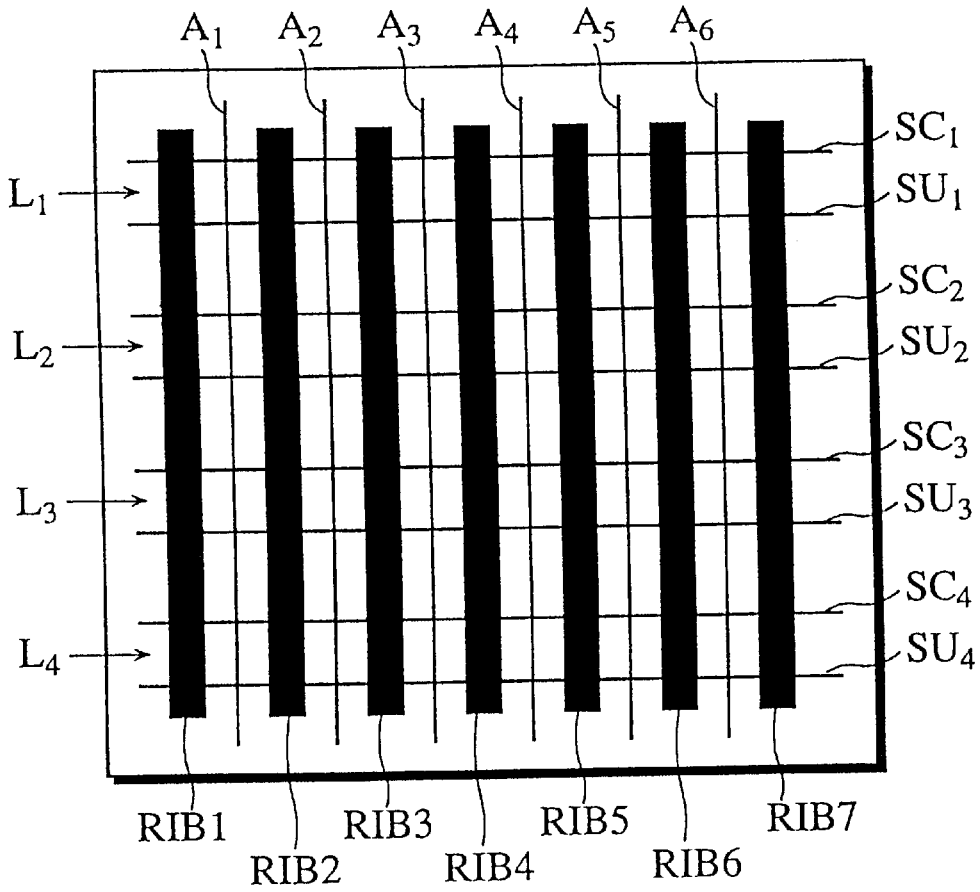
FIG. 13 PRIOR ART
FIG. 13 shows an electrode matrix of a conventional surface discharge AC PDP.

An electrode matrix of this PDP is the same as that shown in FIG. 13. The scan electrodes $SC_1$–$SC_n$, the sustain electrodes $SU_1$–$SU_n$, and the address electrodes $A_1$–$A_m$are each arranged in the form of stripes. The scan electrodes $SC_1$–$SC_n$ and the sustain electrodes $SU_1$–$SU_n$ are aligned perpendicular to the barrier ribs RIB, whereas the address electrodes $A_1$–$A_m$ are aligned in parallel with the barrier ribs RIB.

The scan electrodes $SC_1$–$SC_n$, the sustain electrodes $SU_1$–$SU_n$, and the address electrodes $A_1$–$A_m$ may be formed solely from metal such as silver, gold, copper, chromium, nickel, or platinum. Alternatively, the scan electrodes $SC_1$–$SC_n$ and the sustain electrodes $SU_1$–$SU_n$ may be formed as compound electrodes in which a narrow silver electrode is placed on a wide transparent electrode made of a conductive metal oxide such as ITO, $SnO_2$, or ZnO.

The dielectric layer 13 is formed on the front glass substrate 11 so as to cover the scan electrodes $SC_n$–$SC_n$ and the sustain electrodes $SU_1$–$SU_n$. In general, a lead glass having a low melting point is used for the dielectric layer 13, though a bismuth glass having a low melting point is applicable too.

The protective layer 14 is a thin layer of magnesium oxide (MgO), and covers the entire surface of the dielectric layer 13.

The barrier ribs RIB are formed on the surface of the dielectric layer 23 in the back panel 20.

The barrier ribs RIB separate adjacent discharge cells, thereby preventing discharge diffusion between adjacent discharge cells. As a result, a high resolution display can be achieved.

The barrier ribs RIB also serve as spacers between the glass substrates 11 and 21. Note here that the barrier ribs RIB are not essential to the PDP. For instance, glass beads may be provided as spacers in place of the barrier ribs RIB.

The discharge gas is a gas mixture containing Xe (e.g. Ne—Xe, He—Xe) . In general, the content of Xe is below 10%, and the filling pressure is below an atmospheric pressure (normally about $1\times10^4$–$7\times10^4$Pa). However, to improve panel brightness and luminous efficiency, the Xe content may be set equal to or greater than 10%, and the filling pressure may be set equal to or greater than the atmospheric pressure ($8\times10^4$Pa or more), as explained later in the fifth embodiment.

Drive Method for the PDP

This PDP is driven using a drive device (a drive device 100 described later), according to the field timesharing gradation display method.

Figure 14:
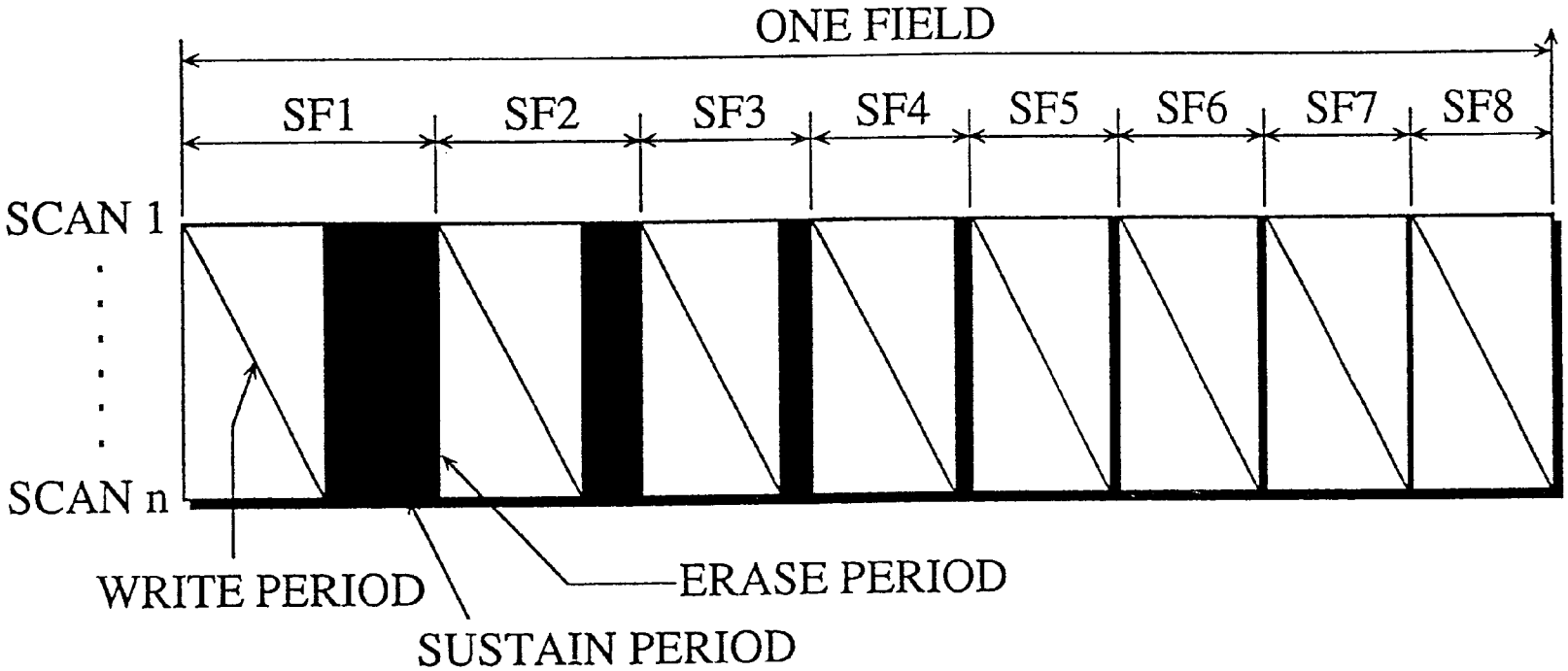
FIG. 14 PRIOR ART
FIG. 14 shows a method of dividing one field when 256 gray levels are expressed.

In the drive method shown in FIG. 14, one field is divided into eight sub-fields SF1–SF8 which are given discharge sustain periods in the ratio of 1, 2, 4, 8, 16, 32, 64, and 128. Combinations of this eight-bit binary express a 256-level gray scale. The NTSC (National Television System Committee) standard for television images stipulates a frame rate of 60 frames per second, so the time for one field is set at 16.7 msec.

Each sub-field is made up of a sequence of a write period and a discharge sustain period. Repeating an operation for one sub-field eight times produces a one-field image display.

Methods of applying pulses to the electrodes in each sub-field are described below, according to the first to fourth embodiments.

First Embodiment

Figure 2:
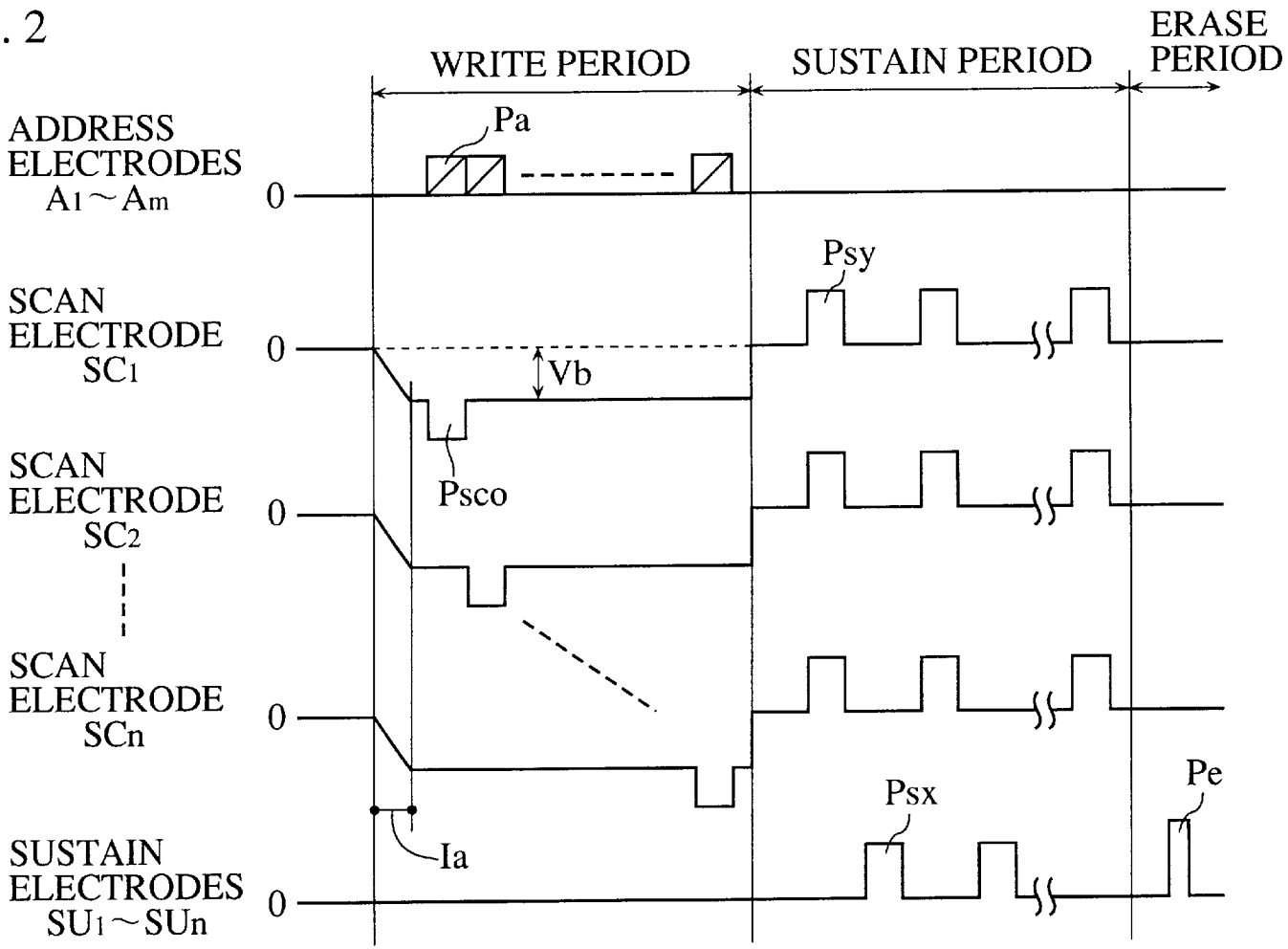
FIG. 2 is a drive timing diagram in the first embodiment of the invention.

FIG. 2 shows an example of drive voltage waveforms when applying pulses to the electrodes in one sub-field, according to the first embodiment.

In the write period, a write pulse $P_a$ of one polarity (positive polarity) is applied to address electrodes which are selected from the address electrodes $A_1$–$A_m$ based on data to be displayed.

Also, a base pulse of the opposite polarity (negative polarity) is applied in bulk to the scan electrodes $SC_1$–$SC_n$ throughout the write period, and a scan pulse $P_{sco}$ having the same polarity as the base pulse (negative polarity) is applied sequentially to the scan electrodes $SC_1$–$SC_n$ in sync with the application of the write pulse $P_a$. This causes write discharge to occur, thereby writing the data.

In the sustain period, sustain pulses $P_{sy}$ and $P_{sx}$ are alternately applied to the scan electrodes $SC_1$–$SC_n$ and the sustain electrodes $SU_1$–$SU_n$. This causes sustain discharge to continuously occur in the discharge cells where the wall charge has accumulated during the write period, as a result of which the data is displayed.

In the erase period, an erase pulse $P_e$ is applied to the sustain electrodes $SU_1$–$SU_n$ to erase the wall charge remaining in the discharge cells.

Base Pulse

The base pulse is a wide pulse which is applied throughout the write period. The leading edge of the base pulse has a ramp waveform in which the voltage varies gradually with an approximately constant slope. In other words, the voltage applied to the scan electrodes $SC_1$–$SC_n$ in an introduction part $I_a$ (i.e. from when the leading edge of the base pulse starts until immediately before the base voltage $V_b$ is reached) of the write period reaches the constant base voltage $V_b$ after the gradual change. Meanwhile, the scan pulse $P_{sco}$ is not applied during the introduction part $I_a$ of the write period, but is applied after the base pulse reaches the base voltage $V_b$. The ramp waveform is described in detail by Larry F. Weber "Plasma Display Device Challenges" in *ASIA DISPLAY* 98, pp.23–27.

The fundamental effects of superimposing the base pulse on the scan pulse $P_{sco}$ are explained next.

In the PDP, there is a predetermined write discharge firing voltage at which the discharge between the scan electrodes $SC_1$–$SC_n$, and the address electrodes $A_1$–$A_m$ begins. Which is to say, when a voltage which increases gradually in absolute value is applied between the scan electrodes $SC_1$–$SC_n$ and the address electrodes $A_1$–$A_m$, the discharge between the electrodes begins once the voltage has reached a certain level. This level is the write discharge firing voltage.

Generally, if the base pulse is not applied in the write period, the potential difference between the scan pulse $P_{sco}$ and the write pulse $P_a$ needs to be higher than the write discharge firing voltage. However, if the base pulse is applied in the write period, only the sum of the above potential difference and the base voltage $V_b$ of the base pulse needs to exceed the write discharge firing voltage. Therefore, the potential difference between the scan pulse $P_{sco}$ and the write pulse $P_a$ can be set lower then the write discharge firing voltage.

In other words, if the base pulse is applied, a potential difference that exceeds the write discharge firing voltage emerges between the scan electrodes $SC_1$–$SC_n$, and the address electrodes $A_1$–$A_m$ when the scan pulse $P_{sco}$ and the write pulse $P_a$ are applied, with no need to increase the voltage of the write pulse $P_a$. As a result, the write discharge takes place unfailingly.

In this case, the sum of the voltage between the scan electrodes $SC_1$–$SC_n$, and the address electrodes $A_1$–$A_m$ and the potential difference between the scan pulse $P_{sco}$ and the write pulse $P_a$ is smaller than the write discharge firing voltage at the time when the application of the base pulse starts. The sum, however, increases with time during the introduction part $I_a$, and reaches the write discharge firing voltage halfway through the introduction part $I_a$. Which is to say, the sum exceeds the write discharge firing voltage at the end of the introduction part $I_a$, at least before the application of the scan pulse $P_{sco}$ begins.

Also, the gradual slope of the leading edge of the base pulse has the following effects.

Figure 16:
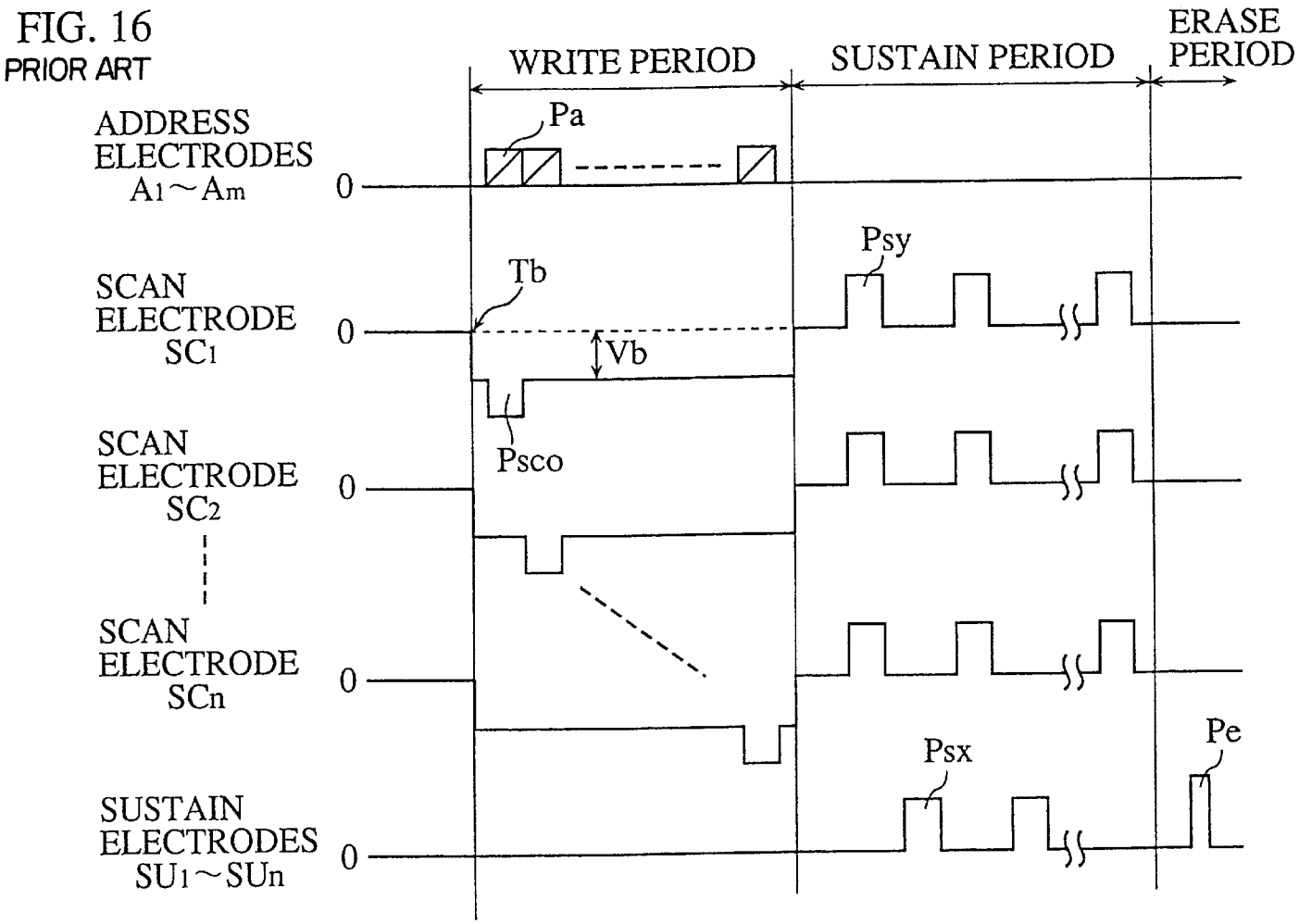
FIG. 16 PRIOR ART
FIG. 16 shows drive voltage waveforms according to a conventional drive method.

When applying a base pulse of a steep leading edge as shown in FIG. 16 in the write period, if the absolute value of the base voltage $V_b$ is high, the voltage between the scan and sustain electrodes may exceed the write discharge firing voltage at a base pulse start point $T_b$ while no discharge is taking place between the address and scan electrodes. This causes a large discharge and results in discharge errors. The discharge errors tend to occur when the absolute value of the base voltage $V_b$ is greater than 100V, though depending on panel characteristics. Such a large discharge also causes a drop in contrast due to light emission.

Especially when the dischargeability differs for each discharge cell in the PDP, discharge errors tend to occur in discharge cells which have higher dischargeability.

On the other hand, if a base pulse of a constant and gentle slope is applied in the introduction part $I_a$ of the write period, even if the voltage in a discharge cell exceeds the write discharge firing voltage in the introduction part $I_a$, only a discharge which is too small to contribute to light emission occurs, so that no serious discharge errors will result. The reason why the discharge occurring at this stage is small is that the voltage in the discharge cell will not greatly exceed the write discharge firing voltage because the voltage varies only gradually. Even if discharge occurs, it stops in a short time.

Thus, by employing a base pulse with a gentle leading edge, discharge errors are suppressed even when the absolute value of the base voltage $V_b$ is set higher than 100V. Also, a drop in contrast associated with light emission in the introduction part $I_a$ is prevented.

The average slope in the introduction part $I_a$ (i.e. from when the leading edge of the base pulse begins until immediately before the base voltage $V_b$ is reached) is preferably 10V/μsec or below.

Also, the average slope may be 10V/μsec or below, in a period from the base pulse start point until the sum of the voltage between the scan electrodes $SC_1$–$SC_n$, and the address electrodes $A_1$–$A_m$ and the potential difference between the scan pulse $P_{sco}$ and the write pulse $P_a$ reaches the write discharge firing voltage (firing voltage reaching point).

Further, the scan pulse $P_{sco}$ may be applied at the time when the base pulse reaches the base voltage $V_b$, or a predetermined time interval after the base pulse reaches the base voltage $V_b$. That is, a time during which the average slope is 10V/μsec or below need be included within the period from when the application of the base pulse starts until immediately before the scan pulse $P_{sco}$ is applied.

As another advantage of using the base pulse of the gradual leading edge, priming effects which are obtained by small discharge which occurs when the voltage changes gradually assist the occurrence of the subsequent write discharge, thereby reducing discharge delays and variations. This further benefits reliable writing of data.

Modifications of the Waveform of the Base Pulse in the Introduction Part $I_a$ The base pulse shown in FIG. 2 has a ramp waveform that linearly changes in the introduction part $I_a$. However, the same effects can be attained so long as the average slope in the introduction part $I_a$ or before the firing voltage reaching point in the introduction part $I_a$ is not greater than 10V/μsec, even if the slope exceeds 10V/μsec during a short time.

Figure 3A:
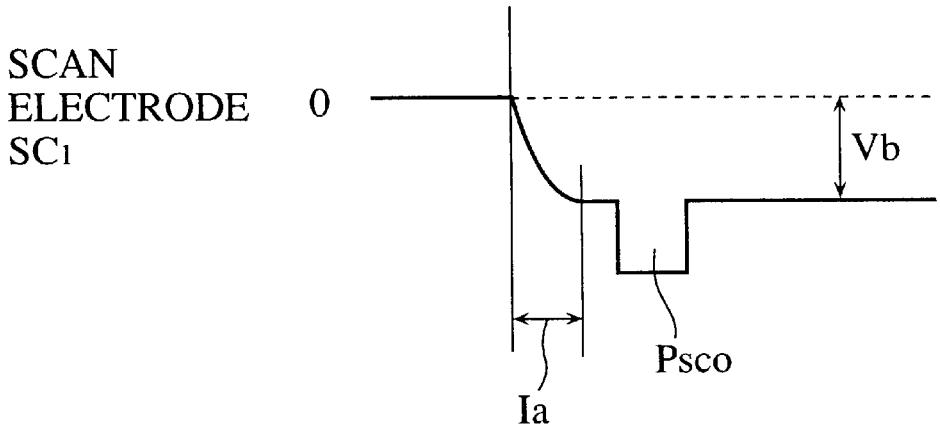
FIGS. 3A–3C show modified waveforms of an introduction part of a base pulse shown in FIG. 2.
Figure 3B:
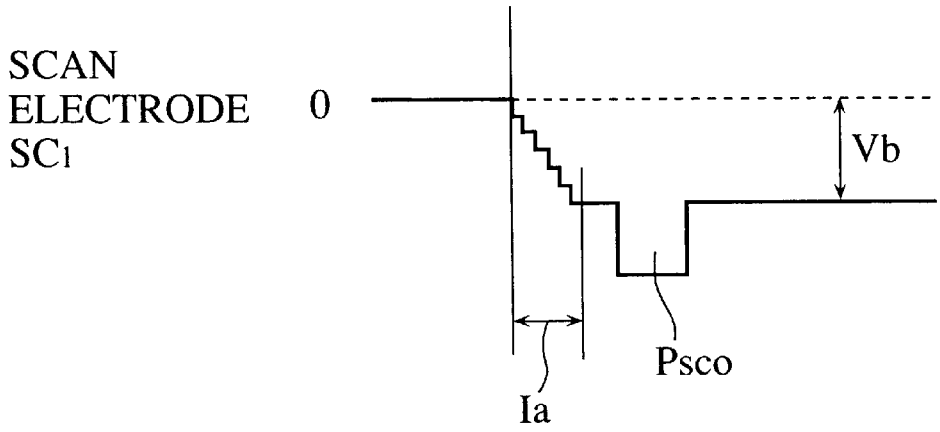
Figure 3C:
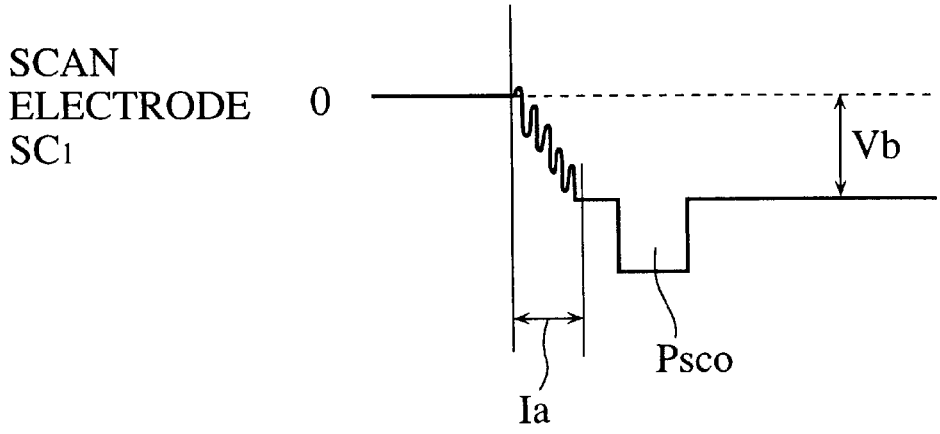

FIG. 3 shows modifications of the waveform of the base pulse in the introduction part $I_a$. In FIG. 3A, the base pulse waveform has a portion that changes exponentially in the introduction part $I_a$. In FIG. 3B, the base pulse waveform has a portion that changes like a gradual staircase in the introduction part $I_a$. In FIG. 3C, the base pulse waveform has a portion that changes with fine oscillations in the introduction part $I_a$. All of these patterns and their combinations deliver the above effects, as long as the average slope is not greater than 10V/μsec.

According to the drive method of the first embodiment, reliable writing can be performed on a PDP that has discharge cells with low dischargeability.

Second Embodiment

Figure 4:
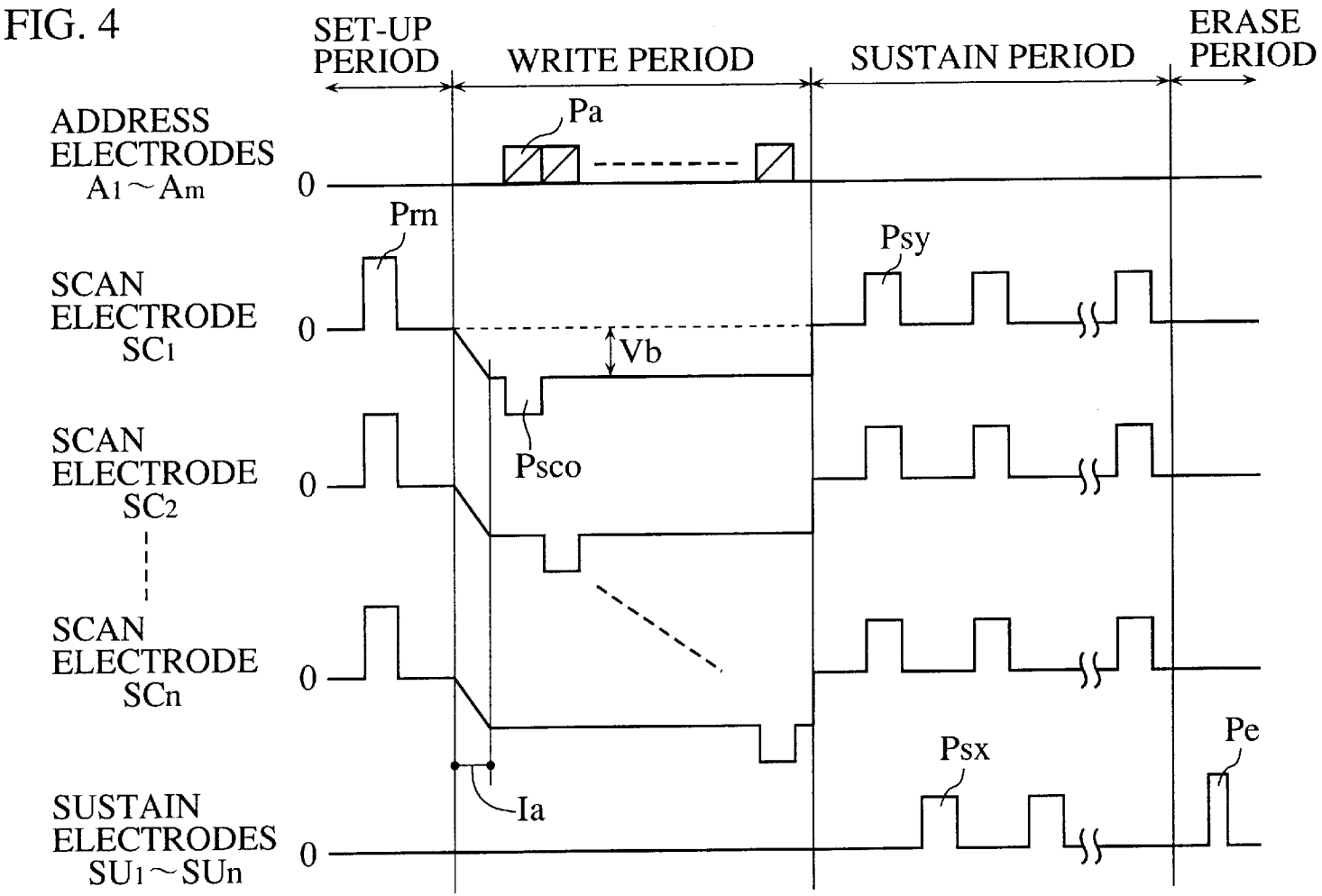
FIG. 4 is a drive timing diagram in the second embodiment of the invention.

FIG. 4 shows an example of drive voltage waveforms according to the second embodiment.

In this embodiment, the same voltage waveforms as in the first embodiment are applied to the electrodes in the write to erase periods. Further, a set-up pulse $P_{rn}$ is applied to the scan electrodes $SC_1$–$SC_n$ in a set-up period.

This produces the following effects.

Figure 17:
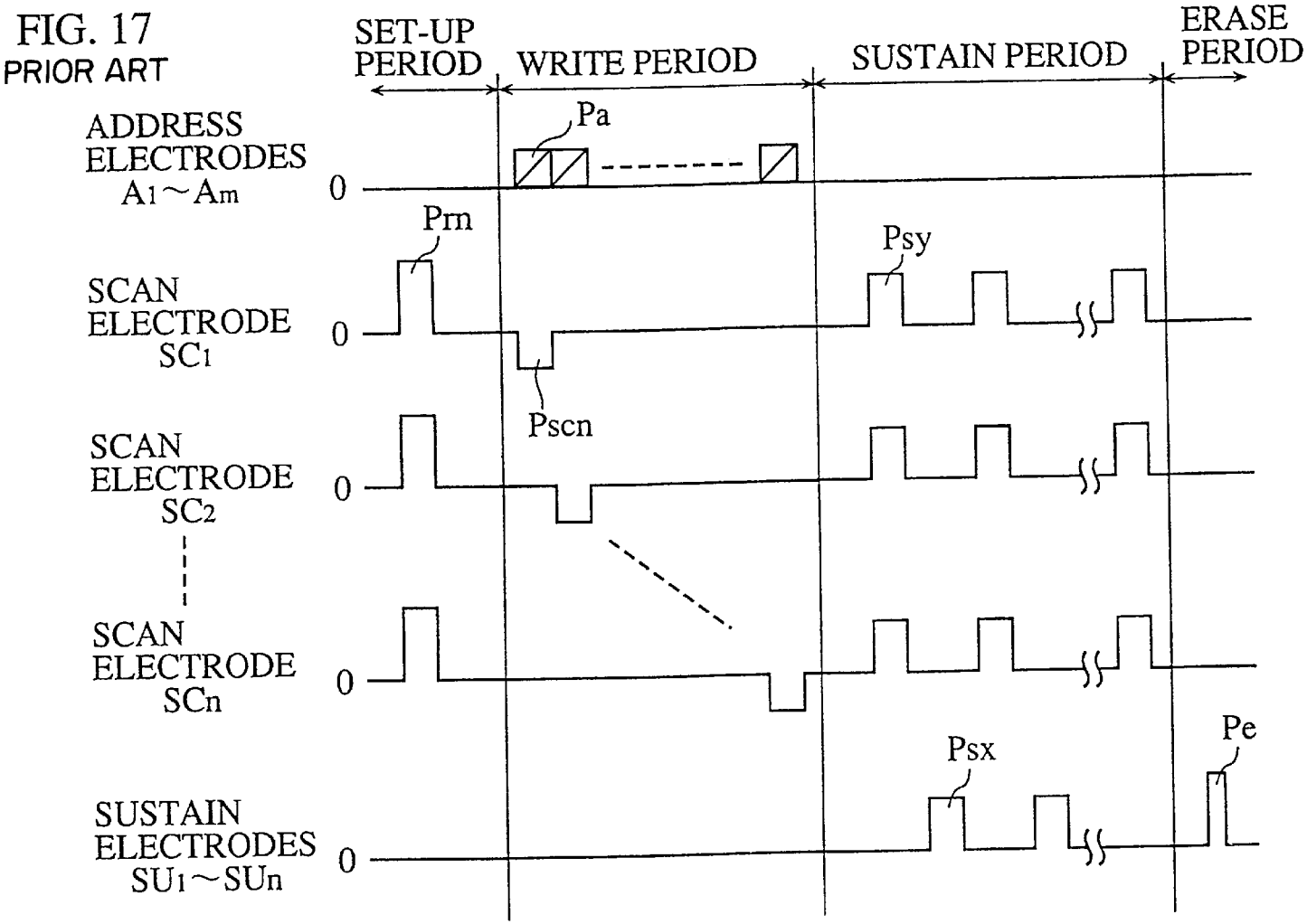
FIG. 17 PRIOR ART
FIG. 17 shows drive voltage waveforms according to a conventional drive method.

After the positive set-up pulse $P_{rn}$ of the rectangular wave is applied in the set-up period as shown in FIG. 17, the wall charge remaining in the discharge cells after the erase discharge in the immediately preceding sub-field is completely neutralized, which facilitates the occurrence of the write discharge. This being so, when the negative base pulse of the steep leading edge shown in FIG. 16 is applied in the write period, the likelihood of discharge errors at the base pulse start point $T_b$ increases, when compared with the case where no set-up is performed. Which is to say, if the set-up is performed, discharge errors tend to occur when the absolute value of the base voltage $V_b$ is greater than 15V, though depending on panel characteristics.

To prevent this, a base pulse is applied which changes gradually in voltage in the introduction part $I_a$ of the write period, as shown in FIG. 4. As a result, even if a discharge cell has become prone to discharge due to the application of the set-up pulse, only a discharge which is too small to contribute to light emission takes place after the voltage in the discharge cell exceeds the write discharge firing voltage in the introduction part $I_a$, as explained in the first embodiment. Accordingly, no serious discharge errors will result.

In this embodiment, the average slope in the introduction part $I_a$ or before the firing voltage reaching point in the introduction part $I_a$ is preferably 10V/μsec or below.

Also, the modifications of the base pulse waveform in the introduction part $I_a$ presented in the first embodiment apply to this embodiment.

Thus, by applying a set-up pulse and further a base pulse of a gentle leading edge, not only are the effects of both the application of the set-up pulse and the application of the base pulse attained, but also are discharge errors suppressed. This enables writing to be performed with greater reliability.

Third Embodiment

Figure 5:
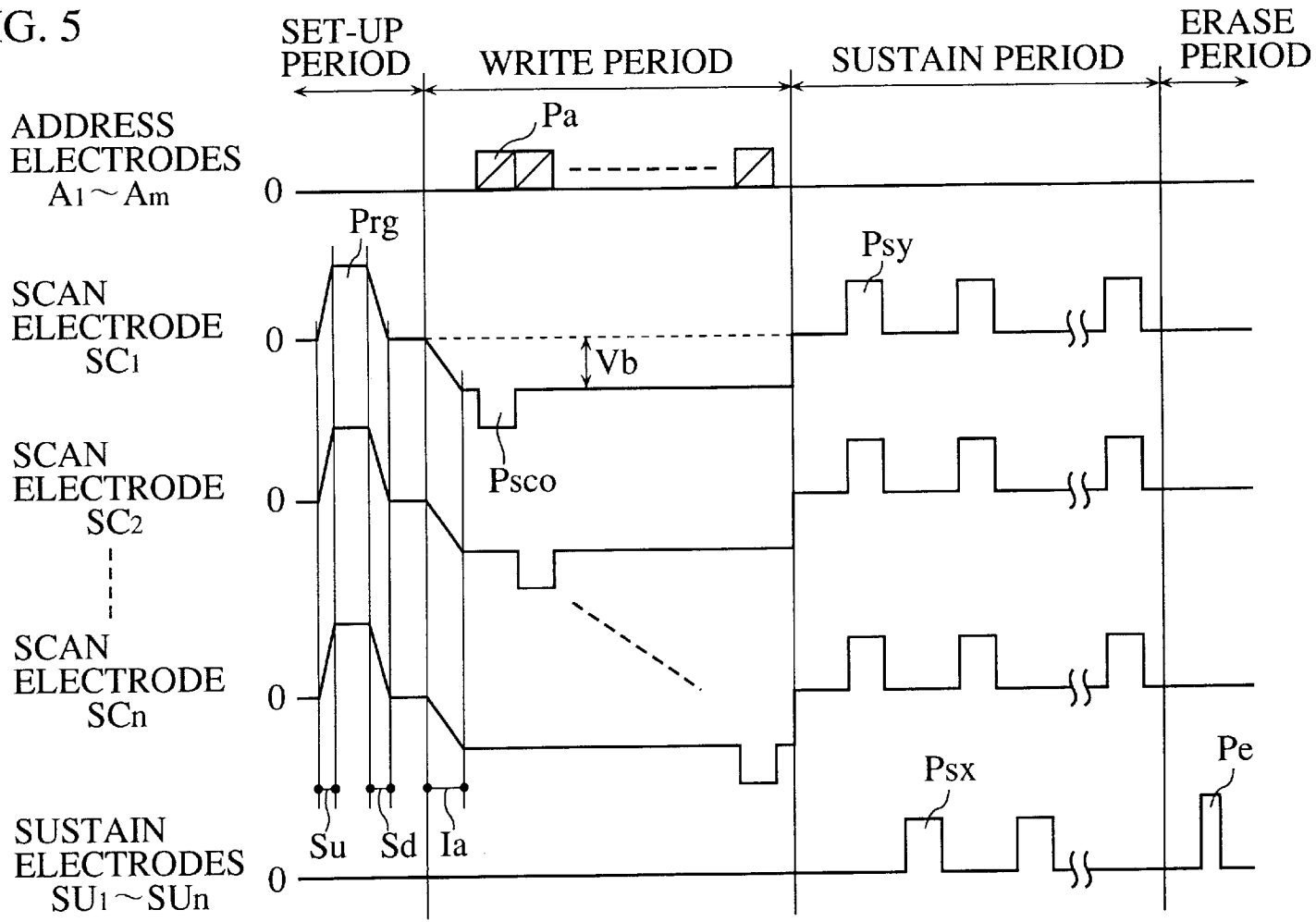
FIG. 5 is a drive timing diagram in the third embodiment of the invention.

FIG. 5 shows an example of drive voltage waveforms according to the third embodiment.

The drive voltage waveforms of this embodiment are similar to those of the second embodiment. The difference from the second embodiment lie in that a leading edge $S_u$ and trailing edge $S_d$ of a set-up pulse $P_{rg}$ in the set-up period are sloped.

By such sloping the leading edge $S_u$ and trailing edge $S_d$ of the set-up pulse $P_{rg}$, the voltage setting range of the set-up pulse increases when compared with the set-up pulse of the simple rectangular wave in the second embodiment. Also, set-up operations can be carried out more reliably.

In other words, if the slope of the leading edge $S_u$ of the set-up pulse $P_{rg}$ is greater, the voltage varies more gently, so that the discharge occurring at the leading edge $S_u$ is weaker. Therefore, by providing a slope to the leading edge $S_u$ of the set-up pulse $P_{rg}$, the amount of the set-up discharge can be easily controlled, with it being possible to set the absolute value of the voltage of the set-up pulse $P_{rg}$ at a high level.

Suppose the discharge characteristics differ between the discharge cells in the PDP. If there is no slope at the leading edge $S_u$ of the set-up pulse $P_{rg}$, a voltage is abruptly applied in bulk to all discharge cells. This being so, unstable set-up discharge occurs in a discharge cell which has high dischargeability, as a result of the application of an excessive amount of voltage. However, if the set-up pulse $P_{rg}$ has a gentle slope at its leading edge $S_u$, the set-up discharge occurs separately in each discharge cell once the voltage of the set-up pulse $P_{rg}$ has reached an optimum level for set-up discharge, so that set-up operations can be carried out more reliably.

Meanwhile, by providing a slope to the trailing edge $S_d$ of the set-up pulse $P_{rg}$, self-erase discharge at the trailing edge $S_d$ can be suppressed. This enables the absolute value of the voltage of the set-up pulse $P_{rg}$ to be set higher, so that set-up operations can be conducted reliably. Here, the self-erase discharge denotes the following phenomenon. After discharge takes place at the leading edge of a pulse, a wall charge that acts to cancel the voltage of the pulse is accumulated in a discharge cell. This being so, when the pulse decays, the voltage of the wall charge causes discharge in the discharge cell.

The slopes of the leading edge $S_u$ and trailing edge $S_d$ of the set-up pulse $P_{rg}$ preferably have an average voltage change rate of 10V/μsec or below, as in the case of the introduction part $I_a$ of the base pulse.

Although it is desirable to provide slopes to both the leading edge $S_u$ and trailing edge $S_d$ of the set-up pulse $P_{rg}$, reasonable effects can still be achieved by providing a slope to only one of the leading edge $S_u$ and the trailing edge $S_d$.

Even when such a set-up pulse $P_{rg}$ that has slopes at its leading edge $S_u$ and trailing edge $S_d$ is used, if a base pulse of a steep leading edge is used in the write period as shown in FIG. 16, discharge errors are likely to occur at the base pulse start point $T_b$, and the contrast is likely to drop due to light emission, as explained in the second embodiment. However, by providing a slope to the introduction part $I_a$ of the write period, the occurrence of discharge errors at the base pulse start point $T_b$ is avoided and the contrast is kept from decreasing. Hence writing can be performed with reliability.

The modifications of the base pulse waveform in the introduction part $I_a$ described in the first embodiment also apply to this embodiment.

Modifications of the Waveform of the Leading and Trailing Edges of the Set-up Pulse In FIG. 5, the leading edge $S_u$ and trailing edge $S_d$ of the set-up pulse $P_{rg}$ have a ramp waveform that varies linearly. Alternatively, the leading edge $S_u$ and the trailing edge $S_d$ may have a portion that varies exponentially, varies like a gentle staircase, or varies with fine oscillations, as explained in the first embodiment. These patterns may also be used in combination.

According to the drive method of this embodiment, stable writing can be performed for a PDP that has discharge cells with low dischargeability.

Fourth Embodiment

Figure 6:
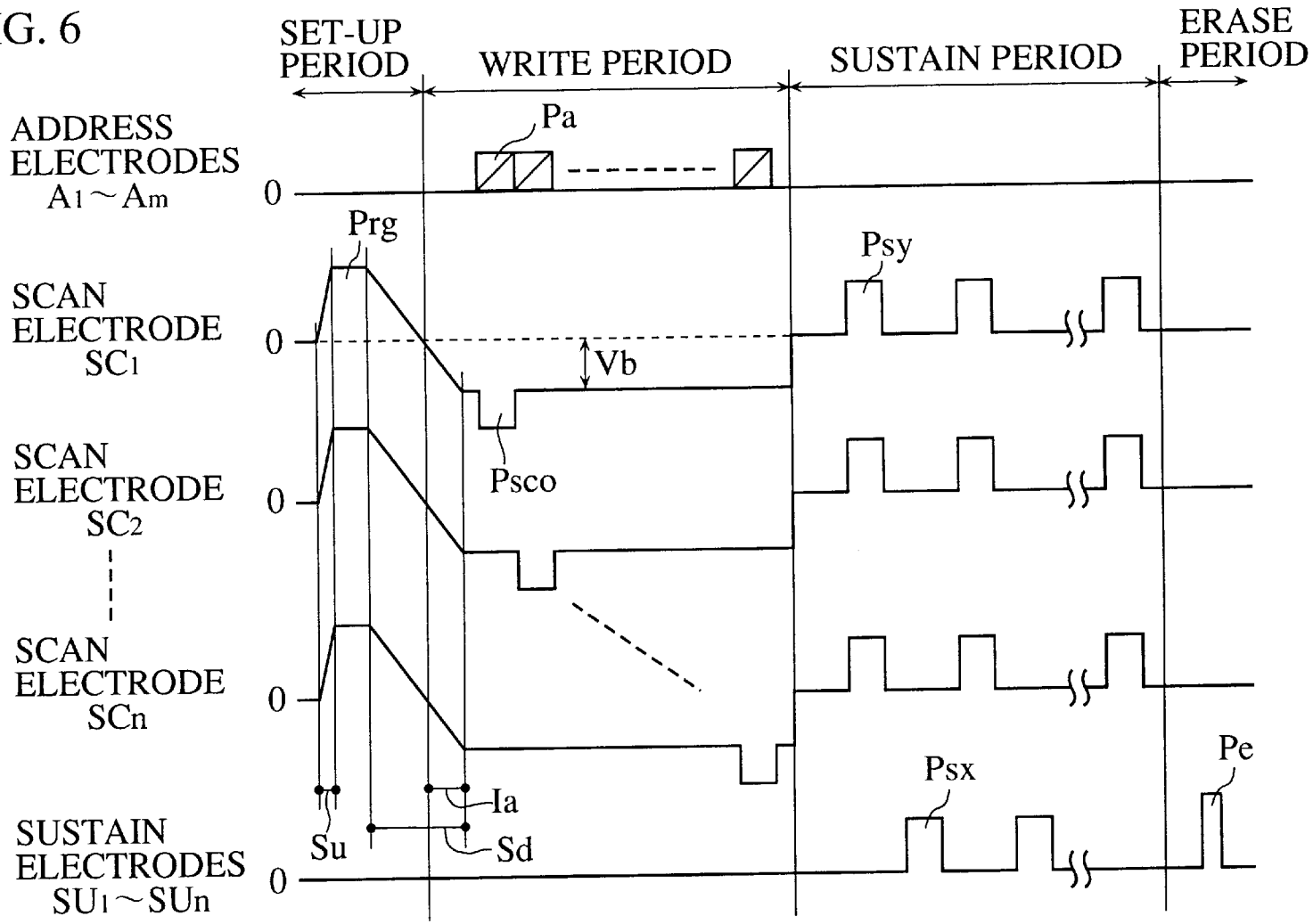
FIG. 6 is a drive timing diagram in the fourth embodiment of the invention.

FIG. 6 shows an example of drive voltage waveforms according to the fourth embodiment.

The drive voltage waveforms of this embodiment are similar to those of the third embodiment, but there is no pause between the trailing edge $S_d$ of the set-up pulse $P_{rg}$ which is applied in the set-up period and the introduction part $I_a$ of the write period. Moreover, a voltage continuously changes with an approximately constant slope, during a period from when the trailing edge $S_d$ of the set-up pulse $P_{rg}$ starts until the base pulse reaches the base voltage $V_b$, or during a period from when the trailing edge $S_d$ of the set-up pulse $P_{rg}$ starts until the firing voltage reaching point.

When the voltage continuously changes from the trailing edge $S_d$ of the set-up pulse $P_{rg}$ through to the base voltage $V_b$ without a pause, a small discharge occurs continuously after the voltage in a discharge cell exceeds the write discharge firing voltage, so that charged particles tend to remain in the discharge space. This increases priming effects. As a result, write discharge delays and variations are greatly reduced.

Hence writing can be performed with greater reliability than the third embodiment, without discharge errors.

Though the voltage changes with an approximately constant slope during the period from the start of the trailing edge $S_d$ of the set-up pulse $P_{rg}$ to the base voltage $V_b$ in FIG. 6, the slope need not be constant, as the same effects can be achieved so long as the voltage change is continuous.

The modifications of the base pulse waveform in the introduction part $I_a$ explained in the first embodiment and the modifications of the waveform of the leading and trailing edges of the set-up pulse explained in the third embodiment also apply to this embodiment.

Fifth Embodiment

In this embodiment, the drive voltage waveforms used when driving the PDP are the same as those in the first to fourth embodiments, but the filling pressure of the discharge gas or the Xe content in the discharge gas is higher.

In other words, the discharge gas filling pressure of the PDP is set no smaller than the atmospheric pressure, or the partial pressure of Xe in the discharge gas is set no smaller than 10%.

Figure 15:
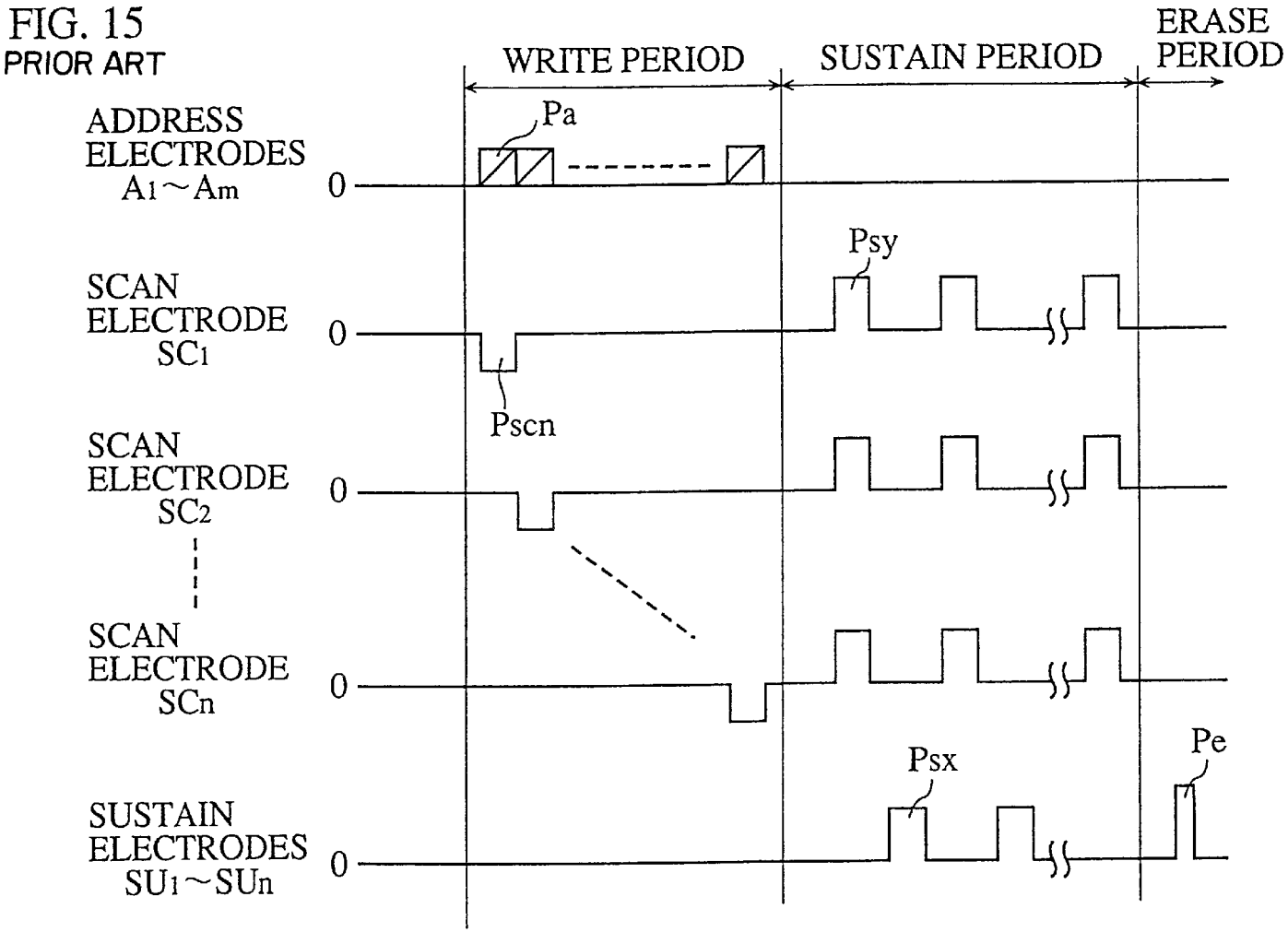
FIG. 15 PRIOR ART
FIG. 15 shows drive voltage waveforms according to a conventional drive method.

Setting the discharge gas filling pressure or the Xe content in the discharge gas in the PDP at a high level has the effect of improving panel brightness and luminous efficiency. In general, however, if the discharge gas filling pressure or the Xe content in the discharge gas is high, the write discharge firing voltage increases according to Paschen's law, so that a high drive voltage is required (Japanese Laid-Open Patent Application No. H06-342631, column 2, lines 8–16, and IEEJ National Symposium S3–1, Plasma Display Discharge, March 1996). Such a PDP is difficult to drive according to the conventional drive method shown in FIG. 15.

The method of increasing the voltage applied to each discharge cell by applying the base pulse to the scan electrodes $SC_1$–$SC_n$, in the write period is also effective, but driving the PDP according to this method requires a high base voltage $V_b$, as explained in the first embodiment. This tends to cause discharge errors at the base pulse start point $T_b$.

In this embodiment, on the other hand, the base pulse of the gentle leading edge (whose average voltage change rate is 10V/μsec or below in the period from the start of the leading edge of the base pulse to the base voltage $V_b$, or in the period from the start of the leading edge of the base pulse to the firing voltage reaching point) is applied to the scan electrodes $SC_1$–$SC_n$, so that discharge errors are unlikely to occur even if the base voltage $V_b$ is set high. Accordingly, driving can be performed easily without discharge errors, even when the discharge gas filling pressure is greater than the atmospheric pressure or the Xe content in the discharge gas is high.

As a result, the PDP can be driven with high brightness, efficiency, and reliability.

It should be noted that when the discharge gas filling pressure or the Xe content in the discharge gas is high as in this embodiment, discharge errors are particularly likely to occur, since a high absolute value of the base voltage $V_b$ is required.

Modifications

The above first to fifth embodiments describe the case where the set-up pulse applied to the scan electrodes $SC_1$–$SC_n$ and the write pulse applied to the address electrodes $A_1$–$A_m$ are of positive polarity, whereas the base pulse and scan pulse applied to the scan electrodes $SC_1$–$SC_n$ are of negative polarity. However, the same effects can be achieved when the set-up pulse applied to the scan electrodes $SC_1$–$SC_n$ and the write pulse applied to the address electrodes $A_1$–$A_m$ are of negative polarity and the base pulse and scan pulse applied to the scan electrodes $SC_1$–$SC_n$ are of positive polarity.

The above embodiments describe the case where the average voltage change rate from the start of the base pulse leading edge to the base voltage $V_b$ or to the firing voltage reaching point is preferably no higher than 10V/μsec, but greater effects can be attained if the average voltage change rate during this period is no higher than 5V/μsec.

Also, the base voltage $V_b$ after the leading edge of the base pulse is described as being constant throughout the write period in the above embodiments, but this is not a limit for the invention. The base voltage $V_b$ may vary to a certain extent, so long as the discharge takes place reliably between the electrodes at least after the firing voltage reaching point.

Drive Device

The drive device that applies drive voltages to the electrodes of the above PDP is described below.

Here, it is assumed that the set-up pulse is applied in the set-up period as in the second to fourth embodiments.

Figure 7:
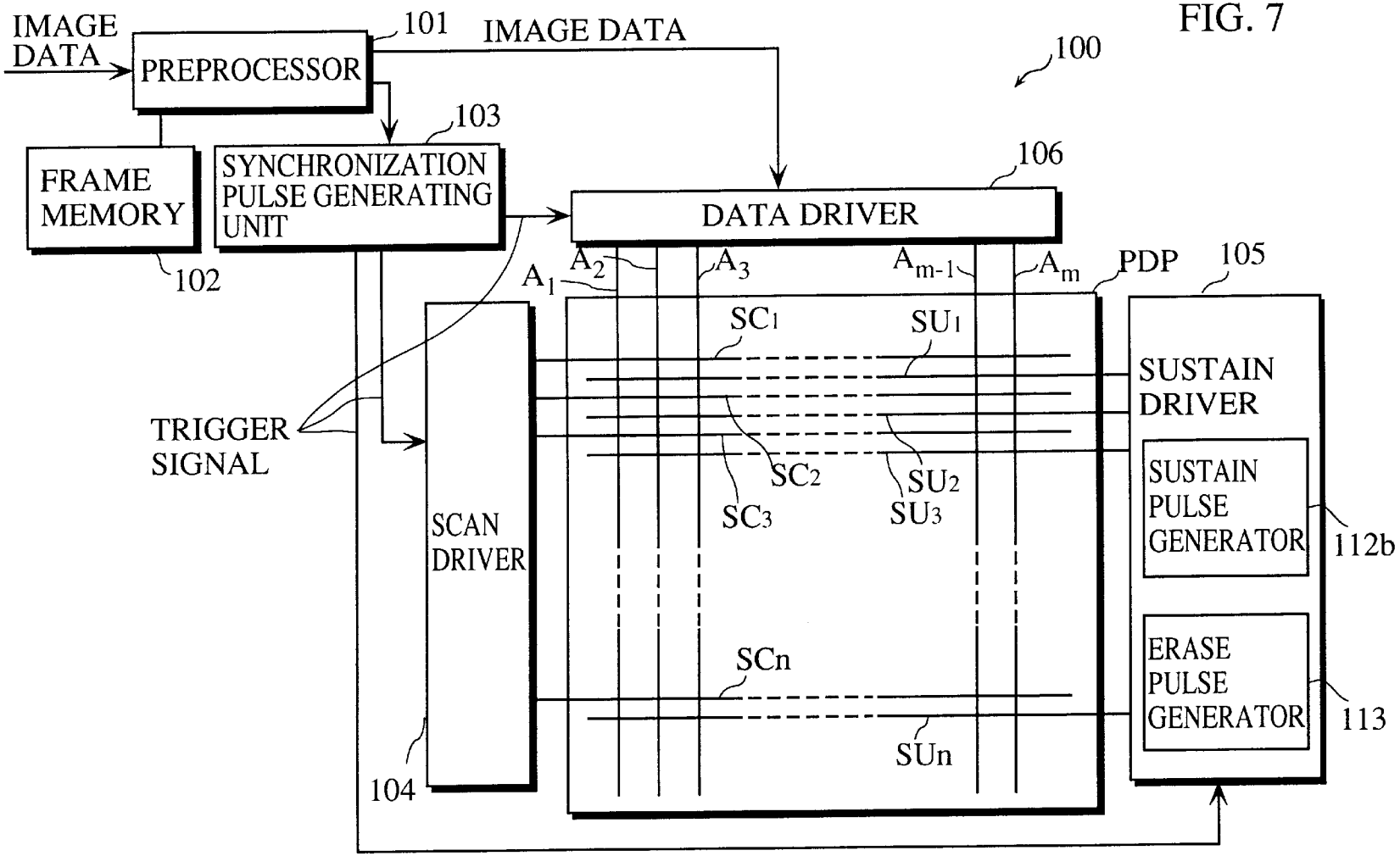
FIG. 7 is a block diagram showing a construction of a drive device to which the embodiments of the invention relate.

FIG. 7 is a block diagram showing a construction of the drive device 100.

This drive device 100 includes a preprocessor 101 for processing image data inputted from an external image output device, a frame memory 102 for storing the processed image data, a synchronization pulse generating unit 103 for generating a synchronous pulse for each field and sub-field, a scan driver 104 for applying pulses to the scan electrodes $SC_1$–$SC_n$, a sustain driver 105 for applying pulses to the sustain electrodes $SU_1$–$SU_n$, and a data driver 106 for applying pulses to the address electrodes $A_1$–$A_m$.

The preprocessor 101 extracts an image of each field (field image data) from the input image data, generates image data of each sub-field (sub-field image data) from the extracted field image data, and stores the sub-field image data in the frame memory 102. The preprocessor 101 also outputs current sub-field image data stored in the frame memory 102 line by line to the data driver 106. The preprocessor 101 further detects synchronization signals such as horizontal synchronization signals and vertical synchronization signals from the input image data, and sends synchronization signals for each field and sub-field to the synchronization pulse generating unit 103.

The frame memory 102 is capable of storing the image data for each field split into sub-field image data for each sub-field.

Specifically, the frame memory 102 is a two-port frame memory provided with two memory areas each capable of storing one field of data (eight sub-field images) An operation in which image data for one field is written in one memory area while image data for another field written in the other memory area is read can be performed alternately on the memory areas.

The synchronization pulse generating unit 103 generates trigger signals indicating the timing of the leading edge of each of the set-up, scan, sustain, and erase pulses, with reference to the synchronization signals received from the preprocessor 101 regarding each field and each sub-field. The synchronization pulse generating unit 103 sends the trigger signals to the drivers 104 to 106.

The scan driver 104 generates and applies the set-up, scan, base, and sustain pulses in response to trigger signals received from the synchronization pulse generating unit 103.

Figure 8:
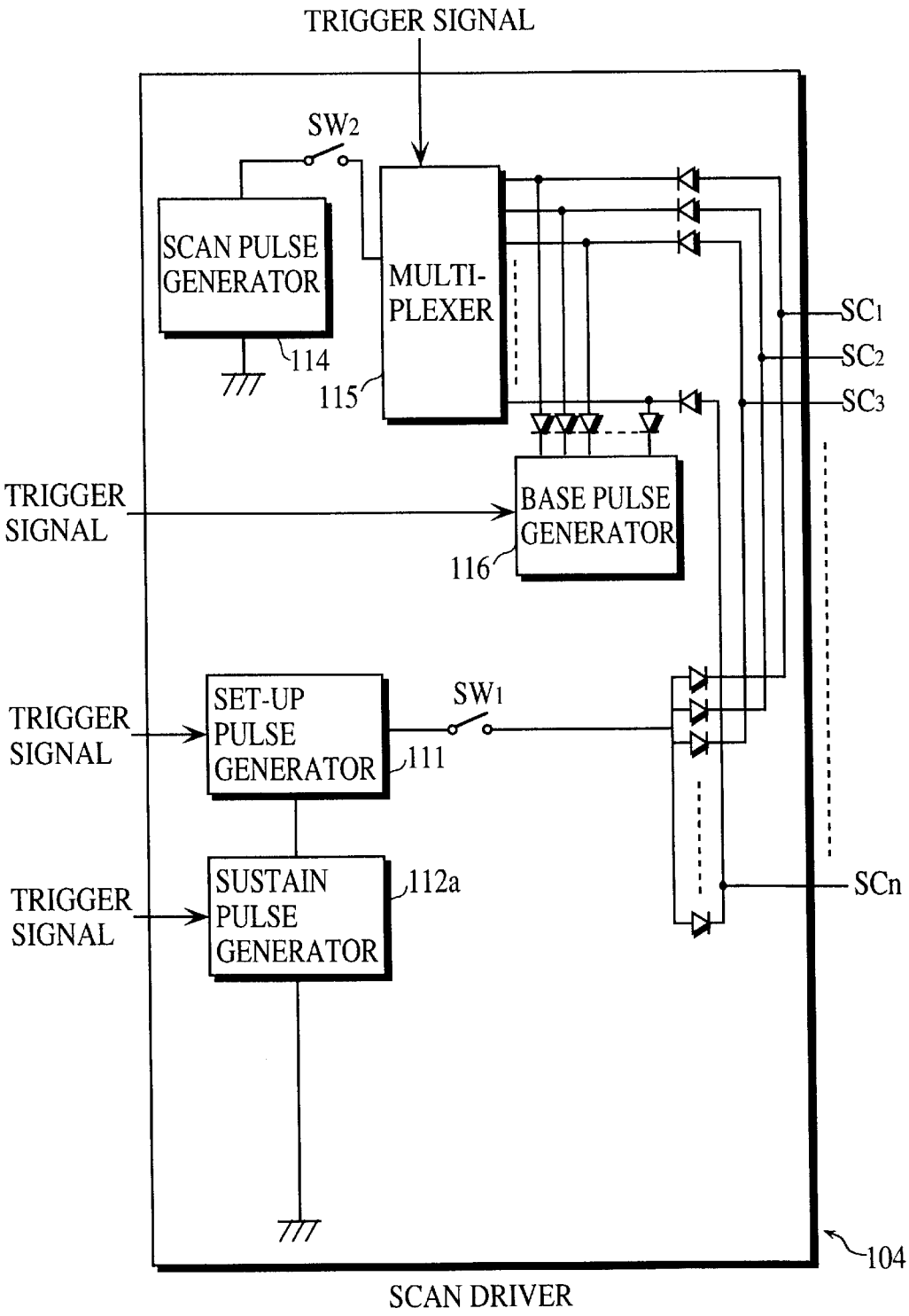
FIG. 8 is a block diagram showing a construction of a scan driver shown in FIG. 7.

FIG. 8 is a block diagram showing a construction of the scan driver 104.

The set-up and sustain pulses are applied in bulk to all scan electrodes $SC_1$–$SC_n$. As a result, the scan driver 104 has two pulse generators, one for generating each kind of pulse. These are a set-up pulse generator 111 and a sustain pulse generator 112*a*. These pulse generators are connected in series using a floating ground method, and apply the set-up and sustain pulses in turn to the scan electrodes $SC_1$–$SC_n$, in response to trigger signals from the synchronization pulse generating unit 103.

The scan driver 104 also includes a scan pulse generator 114 and a multiplexer 115 connected to the scan pulse generator 114, which enable scan pulses to be applied in sequence to the scan electrodes $SC_1$, $SC_2$, . . . , and $SC_n$, as shown in FIG. 8. A method in which pulses are generated in the scan pulse generator 114 and output switched by the multiplexer 115 in response to trigger signals from the synchronization pulse generating unit 103 is used here, but a structure in which a separate scan pulse generating circuit is provided for each of the scan electrodes $SC_1$–$SC_n$ may also be used.

The scan driver 104 further includes a base pulse generator 116 for applying base pulses to the scan electrodes $SC_1$–$SC_n$ in response to trigger signals from the synchronization pulse generating unit 103. The base pulses generated by the base pulse generator 116 are superimposed on the above scan pulses.

Switches SW1 and SW2 are arranged in the scan driver 104 to selectively apply the output from the set-up pulse generator 111 and sustain pulse generator 112 and the output from the scan pulse generator 114 and base pulse generator 116, to the scan electrodes $SC_1$–$SC_n$.

The sustain driver 105 includes a sustain pulse generator 112*b* and an erase pulse generator 113. The sustain driver 105 generates sustain pulses and erase pulses in response to trigger signals from the synchronization pulse generating unit 103, and applies the sustain and erase pulses to the sustain electrodes $SU_1$–$SU_n$.

The data driver 106 outputs data pulses to the address electrodes $A_1$–$A_m$ in parallel. The output takes place based on sub-field information which is inputted serially into the data driver 106 one line at a time.

Constructions of the Set-up Pulse Generator and Base Pulse Generator

The base pulse generator 116 generates a pulse in which a voltage gradually changes at its leading edge. Also, in the case of the third and fourth embodiments, the set-up pulse generator 111 generates a pulse in which a voltage gradually changes at one or both of its leading and trailing edges.

Pulse generation circuits for generating such gradually rising or decaying pulses are explained next.

Figure 9A:
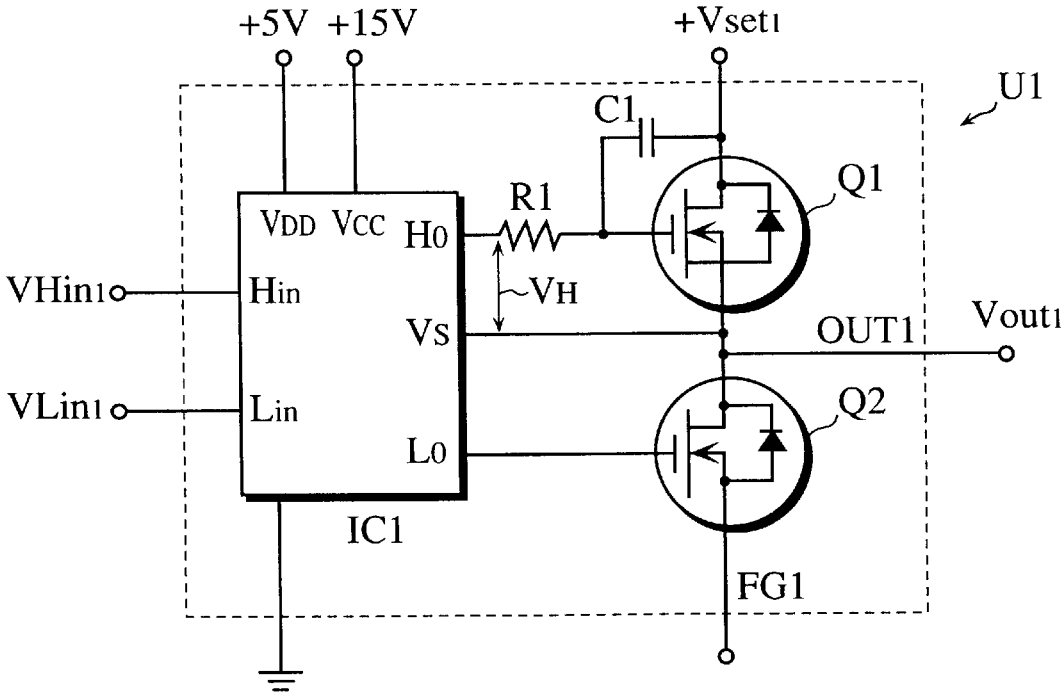
FIGS. 9A–9B, 10A–10B, 11A–11B, and 12A–12B are block diagrams showing constructions of pulse generation circuits used in the first to fourth embodiments, as well as the states of forming pulses by these pulse generation circuits.

A pulse generation circuit U1 shown in FIG. 9A generates a pulse which rises in the form of ramp.

In the pulse generation circuit U1, a pull-up FET Q1 and a pull-down FET Q2 are connected to form a push-pull circuit, to which an IC 1 which is a three-phase bridge driver (e.g. IR-2113 manufactured by International Rectifier) is connected. A capacitor C1 is interposed between the gate and drain of the pull-up FET Q1, and a current limiter R1 is interposed between an $H_0$ terminal of the IC 1 and the gate of the pull-up FET Q1. A fixed voltage $V_{set1}$ is applied to this push-pull circuit.

The pull-up FET Q1, the capacitor C1, and the current limitor R1 form a Miller integration circuit, to produce a ramp waveform with a gentle leading edge.

Figure 9B:
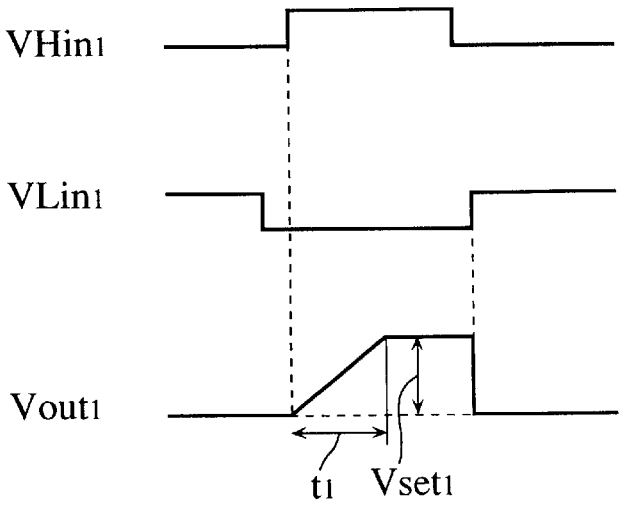

FIG. 9B shows the state of generating a pulse by the pulse generation circuit U1.

As illustrated, when a pulse signal $VH_{in1}$ is inputted to an $H_{in}$ terminal of the IC 1 and a pulse signal $VL_{in1}$ of the opposite polarity is inputted to an $L_{in}$ terminal of the IC 1, the push-pull circuit operates under control of the IC 1, as a result of which a pulse that gradually rises to the voltage $V_{set1}$ is outputted from an output terminal OUT1.

Here, a rise time t1 of the pulse with the gentle leading edge has the following relation with a capacitance C1 of the capacitor C1, the voltage $V_{set1}$, a potential difference $V_H$ between the $H_0$ and $V_s$ terminals of the IC 1, and a resistance R1 of the current limitor R1:

$$t1 = (C1 \cdot V_{set1})/\{(V_{set1} - V_H)/R1\}$$

$$= C1 \cdot R1 \cdot V_{set1}/(V_{set1} - V_H)$$

Hence the rise time t1 can be adjusted by varying the capacitance C1 of the capacitor C1 or the resistance R1 of the current limitor R1.

Figure 10A:
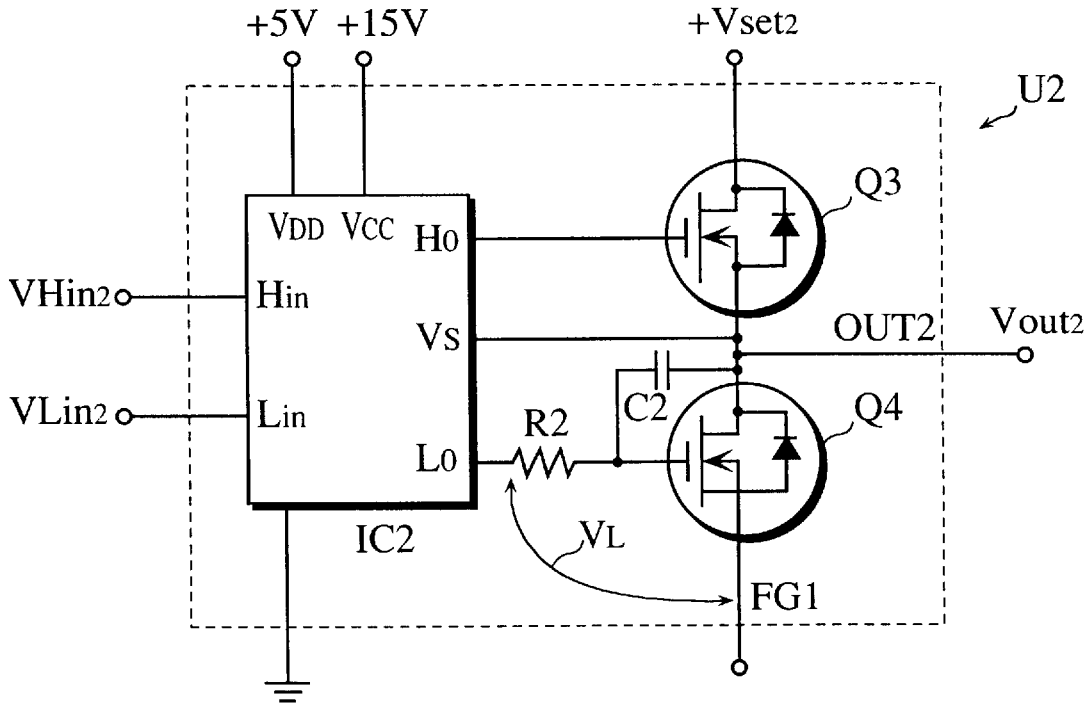

Meanwhile, a pulse generation circuit U2 shown in FIG. 10A generates a pulse which decays in the form of ramp.

In this pulse generation circuit U2, an IC 2 which is a three-phase bridge driver (e.g. IR-2113 by International Rectifier) is connected to a push-pull circuit made up of a pull-up FET Q3 and a pull-down FET Q4. A capacitor C2 is interposed between the gate and drain of the pull-down FET Q4, and a current limiter R2 is interposed between an $L_0$ terminal of the IC 2 and the gate of the pull-down FET Q4. A fixed voltage $V_{set2}$ is applied to this push-pull circuit.

The pull-down FET Q4, the capacitor C2, and the current limiter R2 form a Miller integration circuit, to produce a ramp waveform with a gentle trailing edge.

Figure 10B:
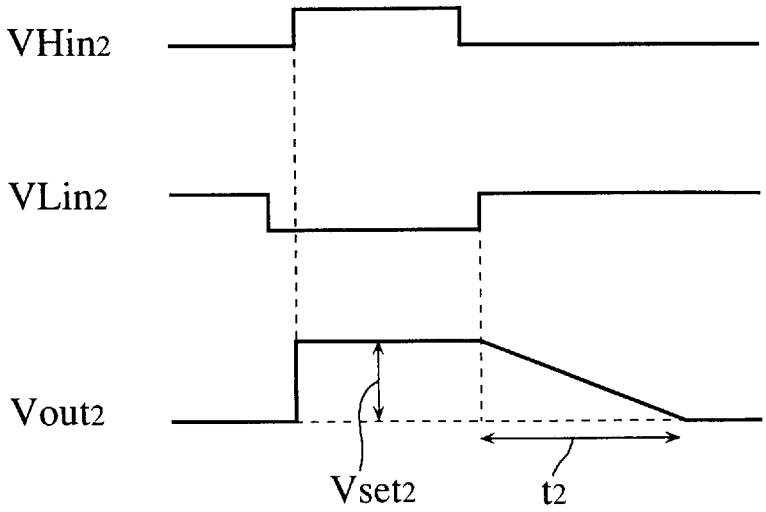

FIG. 10B shows the state of generating a pulse by the pulse generation circuit U2.

As illustrated, when a pulse signal $VH_{in2}$ is inputted to an $H_{in}$ terminal of the IC 2 and a pulse signal $VL_{in2}$ of the opposite polarity is inputted to an $L_{in}$ terminal of the IC 2, the push-pull circuit operates under control of the IC 2, as a result of which a pulse that gradually decays from the voltage $V_{set2}$ in the form of ramp is outputted from an output terminal OUT2.

Here, a decay time t2 of the pulse with the gentle trailing edge has the following relation with a capacitance C2 of the capacitor C2, the voltage $V_{set2}$, a potential $V_L$ of the $L_0$ terminal in the IC 2, and a resistance R2 of the current limiter R2:

$$t2 = (C2 \cdot V_{set2})/\{(V_{set2} - V_L)/R2\}$$

$$= C2 \cdot R2 \cdot V_{set2}/(V_{set2} - V_L)$$

Hence the decay time t2 can be adjusted by varying the capacitance C2 of the capacitor C2 or the resistance R2 of the current limiter R2.

Figure 11A:
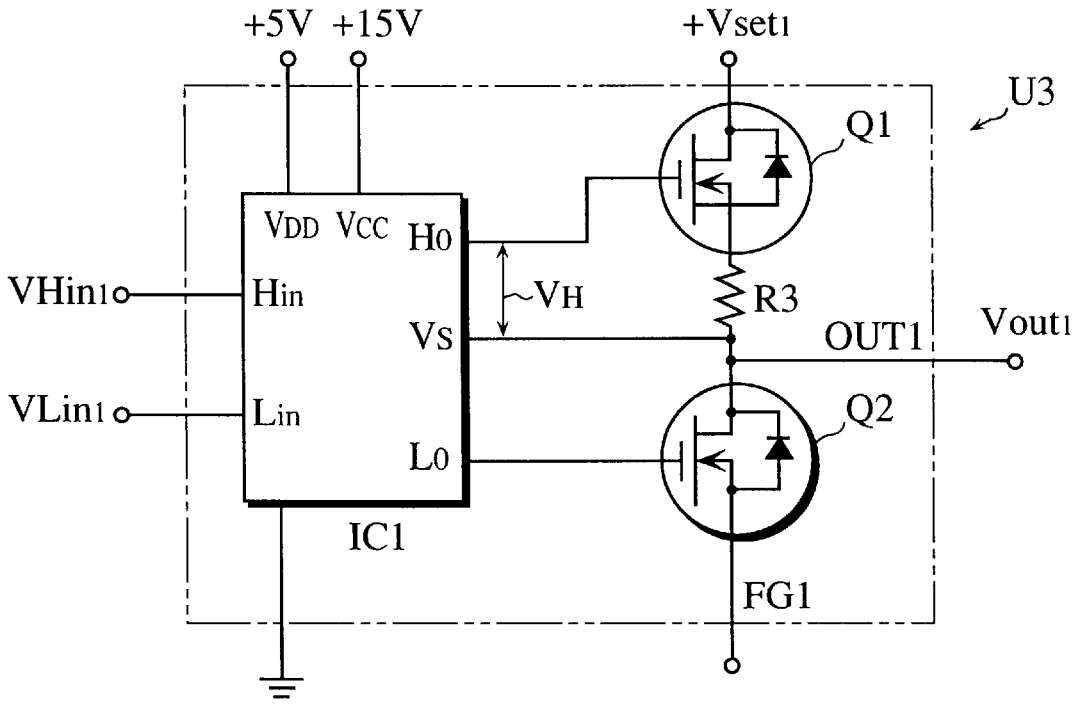

A pulse generation circuit U3 shown in FIG. 11A generates a pulse which rises exponentially.

This pulse generation circuit U3 has a construction similar to that shown in FIG. 9A, but the capacitor Cl between the gate and drain of the pull-up FET Q1 and the current limiter R1 between the $H_0$ terminal of the IC 1 and the gate of the pull-up FET Q1 are removed. Instead, a current limiter R3 is interposed between a $V_s$ terminal of the IC 1 and the source of the pull-up FET Q1.

Figure 11B:
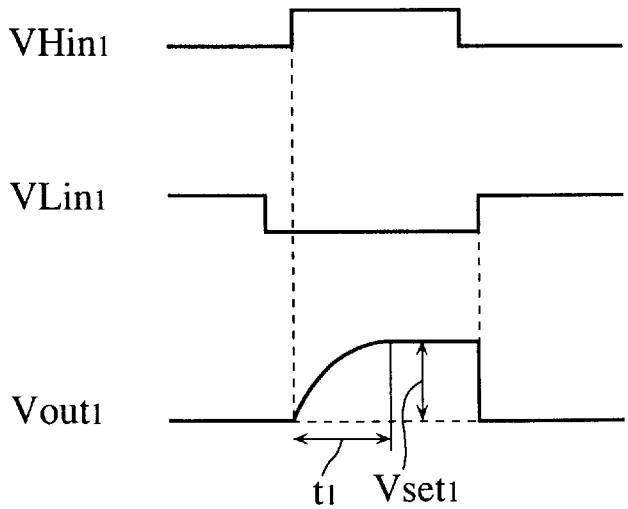

With this pulse generation circuit U3, a waveform which rises exponentially is generated as shown in FIG. 11B.

Figure 12A:
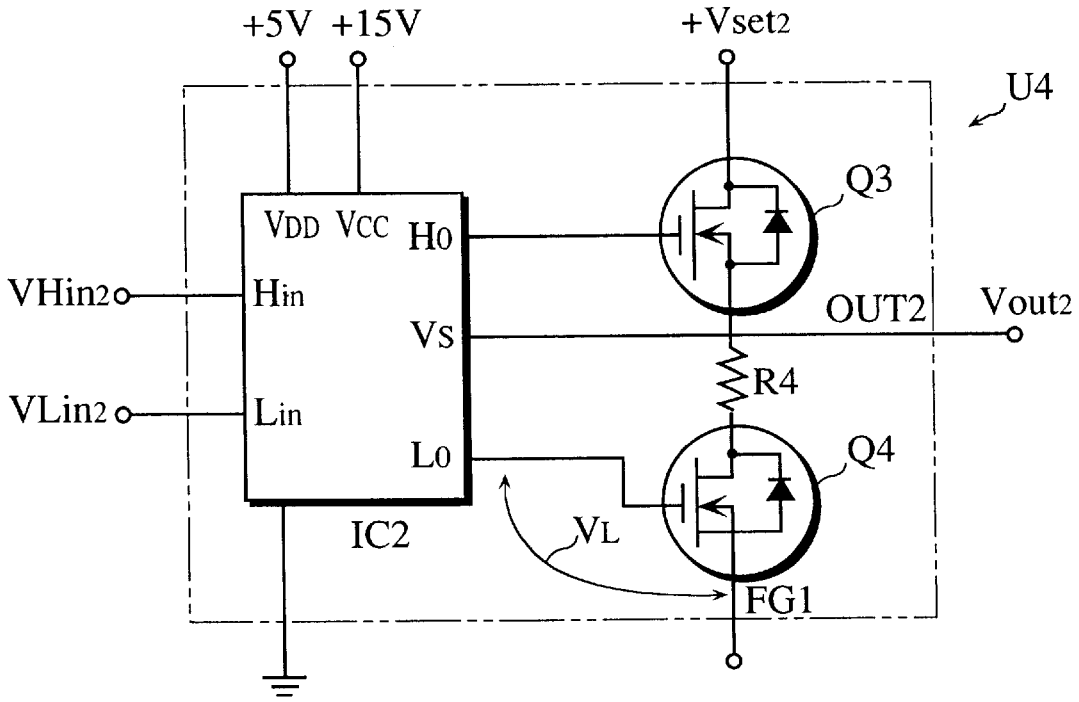

A pulse generation circuit U4 shown in FIG. 12A generates a pulse that decays exponentially.

This pulse generation circuit U4 has a construction similar to that shown in FIG. 10A, but the capacitor C2 between the gate and drain of the pull-down FET Q4 and the current limiter R2 between the $L_0$ terminal of the IC 2 and the gate of the pull-down FET Q4 are removed. Instead, a current limiter R4 is interposed between a $V_s$ terminal of the IC 2 and the drain of the pull-down FET Q4.

Figure 12B:
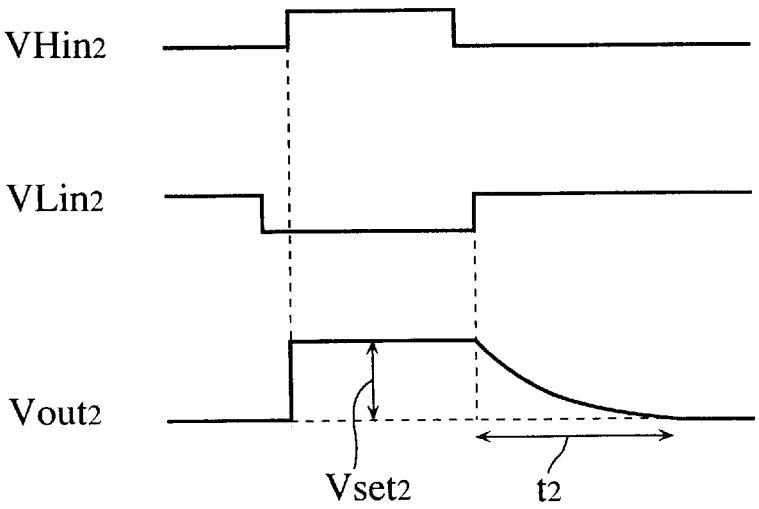

With this pulse generation circuit U4, a waveform that decays exponentially is generated as shown in FIG. 12B.

To generate a pulse waveform that rises in the form of staircase or a pulse waveform that decays in the form of staircase, a staircase wave generation circuit such as a bootstrap staircase wave generation circuit (described in the *Electronics, Information and Communications Handbook* by the Institute of Electronics, Information and Communication Engineers) may be employed.

Although the present invention has been fully described by way of examples with reference to the accompanying drawings, it is to be noted that various changes and modifications will be apparent to those skilled in the art.

Therefore, unless such changes and modifications depart from the scope of the present invention, they should be construed as being included therein.

What is claimed is:

1. A gas discharge display device comprising:

a gas discharge panel having a first substrate and a second substrate that are opposed to each other, a group of first electrodes and a group of second electrodes being arranged on a main surface of the first substrate which faces the second substrate, a group of third electrodes being arranged on a main surface of the second substrate which faces the first substrate so as to cross over the group of first electrodes and the group of second electrodes, and a discharge gas being enclosed in a gap between the first and second substrates; and a drive circuit which writes data in a write period, and sustains a discharge in a sustain period, wherein the drive circuit applies a scan pulse and a base pulse which is superimposed on the scan pulse, to the group of first electrodes in the write period, and a voltage of the base pulse varies at an average rate of no greater than 10V/μsec, during a first period from when the application of the base pulse starts until immediately before the application of the scan pulse starts.

2. The gas discharge display device of claim 1, wherein the base pulse includes a portion in which the voltage varies in the form of a ramp, in the first period.

3. The gas discharge display device of claim 1, wherein the base pulse includes a portion in which the voltage varies exponentially, in the first period.

4. A gas discharge display device comprising:

a gas discharge panel having a first substrate and a second substrate that are opposed to each other, a group of first electrodes and a group of second electrodes being arranged on a main surface of the first substrate which faces the second substrate, a group of third electrodes being arranged on a main surface of the second substrate which faces the first substrate so as to cross over the group of first electrodes and the group of second electrodes, and a discharge gas being enclosed in a gap between the first and second substrates; and a drive circuit which applies a set-up pulse in a set-up period that precedes a write period, writes data in the write period, and sustains a discharge in a sustain period, wherein the drive circuit applies a scan pulse and a base pulse which is superimposed on the scan pulse, to the group of first electrodes in the write period, and a voltage of the base pulse varies at an average rate of no greater than 10V/μsec, during a first period from when the application of the base pulse starts until immediately before the application of the scan pulse starts.

5. The gas discharge display device of claim 4, wherein the base pulse includes a portion in which the voltage varies in the form of a ramp, in the first period.

6. The gas discharge display device of claim 4, wherein the base pulse includes a portion in which the voltage varies exponentially, in the first period.

7. The gas discharge display device of claim 4, wherein the drive circuit applies the set-up pulse to the group of first electrodes, and a voltage of the set-up pulse varies at an average rate of no greater than 10V/μsec, during at least one of a leading edge and a trailing edge.

8. The gas discharge display device of claim 4, wherein the drive circuit applies the set-up pulse to the group of first electrodes, and at least one of a leading edge and a trailing edge of the set-up pulse includes a portion in which a voltage of the set-up pulse varies in the form of a ramp.

9. The gas discharge display device of claim 4, wherein the drive circuit applies the set-up pulse to the group of first electrodes, and at least one of a leading edge and a trailing edge of the set-up pulse includes a portion in which a voltage of the set-up pulse varies exponentially.

10. The gas discharge display device of claim 7, wherein the drive circuit continuously varies a voltage applied to the group of first electrodes at a rate of no greater than 10V/μsec, during a second period from when the trailing edge of the set-up pulse starts until immediately before the application of the scan pulse starts.

11. The gas discharge display device of claim 10, wherein the voltage applied to the group of first electrodes in the second period includes a portion which varies in the form of a ramp.

12. The gas discharge display device of claim 10, wherein the voltage applied to the group of first electrodes in the second period includes a portion which varies exponentially.

13. The gas discharge display device of claim 1, wherein the scan pulse and the base pulse which are applied to the group of first electrodes by the drive circuit have the same polarity.

14. The gas discharge display device of claim 1, wherein a filling pressure of the discharge gas is not smaller than an atmospheric pressure.

15. The gas discharge display device of claim 14, wherein the discharge gas contains Xe, and a partial pressure of Xe with respect to the filling pressure of the discharge gas is not smaller than 10%.

16. The gas discharge display device of claim 4, wherein the scan pulse and the base pulse which are applied to the group of first electrodes by the drive circuit have the same polarity.

17. The gas discharge display device of claim 4, wherein a filling pressure of the discharge gas is not smaller than an atmospheric pressure.

* * * * *